US010921744B2

(12) United States Patent
Yamada

(10) Patent No.: US 10,921,744 B2
(45) Date of Patent: Feb. 16, 2021

(54) IMAGE HEATING APPARATUS

(71) Applicant: CANON KABUSHIKI KAISHA, Tokyo (JP)

(72) Inventor: Koichi Yamada, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/695,577

(22) Filed: Nov. 26, 2019

(65) Prior Publication Data

US 2020/0166885 A1 May 28, 2020

(30) Foreign Application Priority Data

Nov. 28, 2018 (JP) ..... 2018-222243
Dec. 12, 2018 (JP) ..... 2018-232838

(51) Int. Cl.
*G03G 15/00* (2006.01)
*G03G 15/20* (2006.01)

(52) U.S. Cl.
CPC ..... *G03G 15/80* (2013.01); *G03G 15/2053* (2013.01)

(58) Field of Classification Search
CPC ..... G03G 15/80; G03G 15/2053
See application file for complete search history.

(56) References Cited

U.S. PATENT DOCUMENTS

| | | | |
|---|---|---|---|
| 8,983,328 B2 | 3/2015 | Mizuta et al. | |
| 10,254,691 B2 | 4/2019 | Hirose et al. | |
| 10,386,760 B2 | 8/2019 | Nakajima et al. | |
| 2020/0019098 A1* | 1/2020 | Eiki | G03G 15/2017 |

FOREIGN PATENT DOCUMENTS

| | | |
|---|---|---|
| JP | 06-202503 A | 7/1994 |
| JP | 09-319240 A | 12/1997 |
| JP | 11-231696 A | 8/1999 |
| JP | 2000-181260 A | 6/2000 |
| JP | 2013-254192 A | 12/2013 |
| JP | 2015194713 A | 11/2015 |
| JP | 2016151755 A | 8/2016 |

* cited by examiner

*Primary Examiner* — Walter L Lindsay, Jr.
*Assistant Examiner* — Milton Gonzalez
(74) *Attorney, Agent, or Firm* — Venable LLP

(57) ABSTRACT

An image heating apparatus including: a heater including heat generating elements, and electrodes electrically connected to the heat generating elements, respectively and arranged in an orthogonal direction of a conveyance direction of a recording material; and connectors for supplying electric power to electrodes, wherein the connectors include contact portions that come into contact with one of the electrodes, a first supporting portion that supports a first contact portion, and a second supporting portion that supports a second contact portion, the first supporting portion and the second supporting portion are arranged to be spaced apart from each other in the orthogonal direction, the first contact portion extends in a direction toward the second supporting portion, the second contact portion extends in a direction toward the first supporting portion, and the first contact portion and the second contact portion are in contact with the one of the electrodes at different positions.

20 Claims, 15 Drawing Sheets

IMAGE HEATING APPARATUS

BACKGROUND OF THE INVENTION

Field of the Invention

The present invention relates to an image forming apparatus such as a printer or a copying machine using an electrophotographic system or an electrostatic recording system. The present invention also relates to an image heating apparatus such as a gloss applying apparatus that improves the glossiness of a toner image by reheating the toner image fixed on a fixing portion included in the image forming apparatus or a recording material. The present invention also relates to a connector used in the image forming apparatus and the image heating apparatus.

Description of the Related Art

In an image forming apparatus including a fixing apparatus, when small-size sheets of paper are continuously fed, there occurs a phenomenon called end-portion temperature rise that the temperature of a region where a sheet of paper does not pass in the longitudinal direction of the heater becomes very high. When the end-portion temperature rise occurs, parts such as the roller and the heater may be damaged. Japanese Patent Application Publication No. 2015-194713 discloses a heater (hereinafter referred to as a division heater) in which a heat generating element provided on a substrate of the heater is divided into a plurality of blocks in the longitudinal direction of the heater. In the division heater, the power supplied from the electrodes on the substrate is supplied to the plurality of heat generating elements arranged on the substrate via the conductor on the substrate in the longitudinal direction, so that the heat generating elements on the substrate generate heat. The divided heat generating elements can each be controlled independently, and adjust the heat generation distribution of the entire heater according to the paper size, thereby making it possible to suppress the end-portion temperature rise. At this time, the power supply to the electrodes is performed from a commercial AC power source via electrical contact members. A method is used that provides an elastically deformable portion obtained by processing a metal plate of, for example, copper on the electrical contact member, and presses the elastically deformable portion against the electrode to provide a contact. Japanese Patent Application Publication No. 2016-151755 discloses a configuration in which two elastically deformable portions are provided for one electrode to provide two contact portions for the purpose of ensuring the reliability of the electrical contact portion between a commercial AC power source and a heater electrode. Providing a plurality of contacts for one electrode makes it possible to provide an electrode configuration that is more robust against disturbances such as vibrations and minute foreign matters (e.g., dust).

SUMMARY OF THE INVENTION

Copying machines and printers are required to shorten the time from when a user sends a print signal until a recording material is discharged (first printout time, FPOT), thereby reducing the waiting time of the user. In order to meet this requirement, fixing apparatuses are required to shorten the time from when the print signal is received until the temperature of a fixing film rises to a predetermined temperature. Then, shortening the heater width in the conveyance direction of the recording material to reduce the heat capacity of the heater is effective as one means for reducing the rise time. However, in the division heater disclosed in Japanese Patent Application Publication No. 2015-194713, when the heater width is shortened, the electrode width is shortened accordingly. When the electrode width is shortened, it is difficult to ensure a space for arrangement of a plurality of contacts for one electrode.

For example, an electrical contact part 800 as illustrated in FIG. 13 is disclosed in Japanese Patent Application Publication No. 2016-151755. The electrical contact part 800 includes elastic deformation portions 801A and 801B, and contact portions 802A and 802B. The contact portions 802A and 802B are pressed against the electrodes by the elasticity of the elastic deformation portions 801A and 801B, respectively. Here, the minimum value of the distance between the contact portion 802A and the contact portion 802B is a value determined from the processing limit of the metal plates, and cannot be made infinitely small. For this reason, it is necessary for a short width heater in which a plurality of contacts for one electrode are provided to devise the shape of the electrical contact part.

An object of the present invention is to provide a technique capable of improving the reliability of the electrical contact with the FPOT shortened.

In addition, when a connector is mounted on the fixing apparatus, it is necessary to determine the relative positional relationship between the connector and the heater. Since the connector cannot be directly engaged with the heater, a configuration is adopted that the connector is engaged with a holder member for holding the heater so that the connector and the electrode of the heater are brought into contact with each other. When such a configuration is adopted, there are the following problems. When power is supplied to the heater, there is a time lag in the heat conduction from the heater to the holder member. Specifically, at the moment when power is supplied to the heater, the heater thermally expands in the longitudinal direction, and then the holder member starts to expand. Further, the heater and the holder member generally have different linear expansion coefficients, and the relative positions of the heater and the holder member differ accordingly when the temperature is saturated. Thus, the heater and the holder member are relatively displaced in a process where the temperature of the heater or the holder member changes. Since the connector is engaged with the holder member, the connector is displaced relative to the heater. As a result, the electrode of the heater and the contact portion of the connector repeatedly slide each time a printing operation is performed. In recent years, printers and copying machines have been required to have longer lifespans. In printers and copiers having a long service life, their electrodes and electrical contacts may wear out, thereby making electrical contact unstable. In addition, a cable is connected to the connector, and the connector may be displaced due to a posture change of the cable during assembly or a position change of the cable during operation, thereby making the electrodes and the connector worn.

Another object of the present invention is to suppress sliding between the electrode of the heater and the contact portion of the connector.

In order to achieve the object described above, an image heating apparatus according to the present invention including:

a heater including a plurality of heat generating elements, and a plurality of electrodes electrically connected to the plurality of heat generating elements, respectively and arranged in an orthogonal direction of a conveyance direction of a recording material; and a plurality of connectors for supplying electric power to each of the plurality of electrodes, wherein the plurality of connectors includes a plurality of contact portions that come into contact with one of the plurality of electrodes, a first supporting portion that supports a first contact portion of the plurality of contact portions, and a second supporting portion that supports a second contact portion of the plurality of contact portions, the first supporting portion and the second supporting portion are arranged to be spaced apart from each other in the orthogonal direction, the first contact portion extends in a direction toward the second supporting portion, the second contact portion extends in a direction toward the first supporting portion, and the first contact portion and the second contact portion are in contact with the one of the plurality of electrodes at different positions.

In order to achieve the object described above, an image heating apparatus according to the present invention including:

a heater including an elongated substrate, a plurality of heat generating elements provided on the substrate; and an electrode provided on the substrate and electrically connected to the plurality of heat generating elements, respectively;

a connector connected to the electrode; and a holding member that holds the heater, wherein the heater generates heat with electric power supplied via the connector, and an image formed on a recording material is heated using the heat of the heater, and the connector includes a contact portion that comes in contact with the electrode to be electrically connected to the electrode, a fixing portion for fixing the connector to the holding member, and an elastically deformable elastic portion that is provided between the contact portion and the fixing portion and is connected to the contact portion and the fixing portion.

According to the present invention, it is possible to improve the reliability of the electrical contact with the FPOT shortened. In addition, according to the present invention, it is possible to suppress sliding between the electrode of the heater and the contact portion of the connector.

Further features of the present invention will become apparent from the following description of exemplary embodiments with reference to the attached drawings.

DESCRIPTION OF THE EMBODIMENTS

First Embodiment

Outline of Image Forming Apparatus

Figure 1:
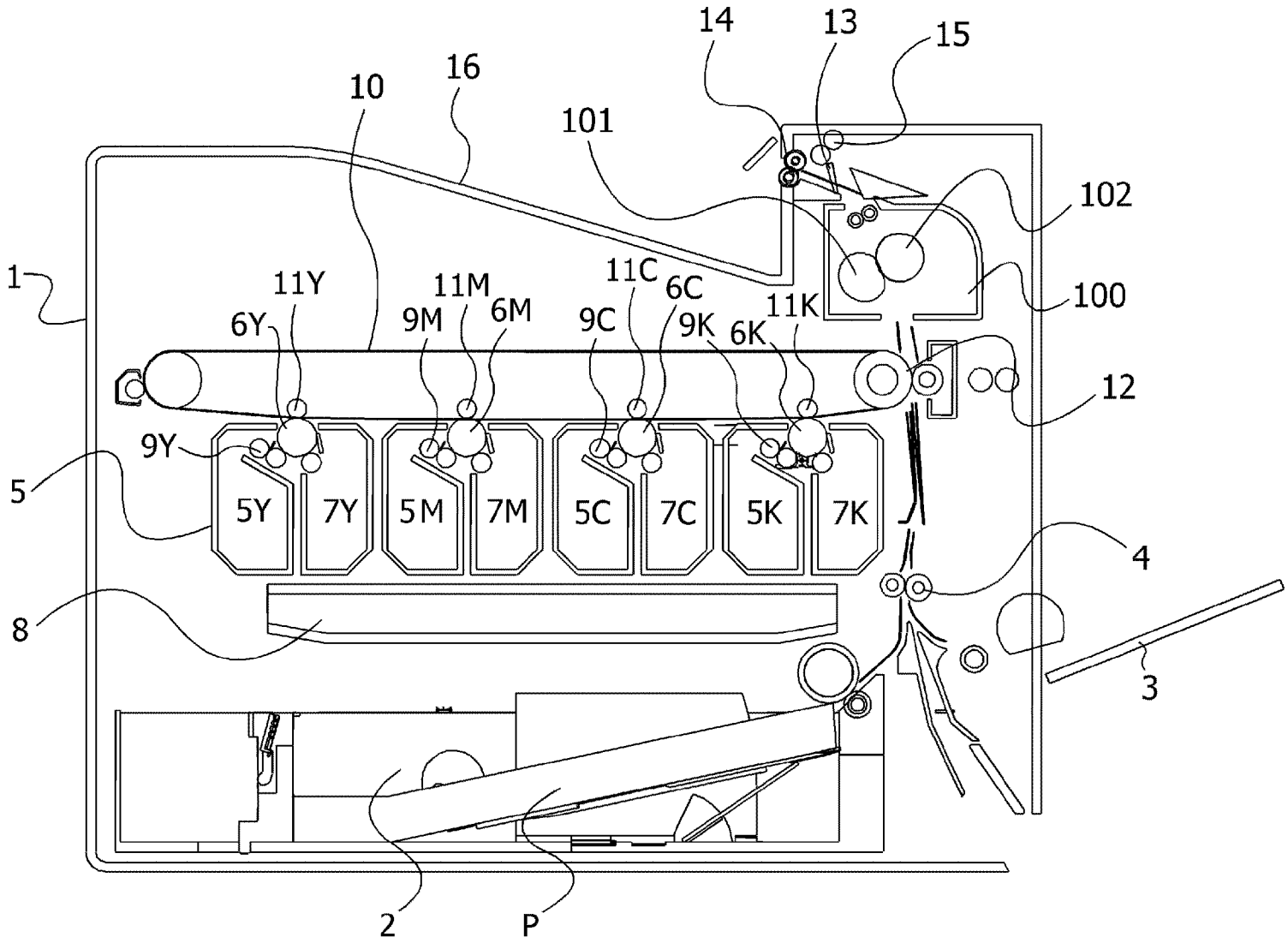
FIG. 1 is a cross-sectional view of an image forming apparatus according to a first embodiment.

To begin with, an image forming apparatus to which the present invention can be applied will be described. FIG. 1 is a longitudinal sectional view illustrating the overall configuration of a printer (image forming apparatus) 1 according to a first embodiment. A cassette 2 is housed in a lower section of the printer 1 so as to be drawable. A manual feed portion 3 is disposed on the right side of the printer 1. A recording material P is stacked and accommodated in each of the cassette 2 and the manual feed portion 3, and the recording material P is separated one by one and fed to a registration roller 4. The printer 1 includes an image forming portion 5 in which image forming stations 5Y, 5M, 5C, and 5K corresponding, respectively, to yellow, magenta, cyan, and black are arranged in a horizontal row. The image forming portion 5 forms a toner image on the recording material P. In the image forming portion 5, photosensitive drums 6Y, 6M, 6C, and 6K that are image bearing members, and charging apparatuses 7Y, 7M, 7C, and 7K that uniformly charge the surface of the photosensitive drum 6, are arranged. Hereinafter, the photosensitive drums 6Y, 6M, 6C, and 6K, as collectively referred to, are referred to as the photosensitive drum 6. Also in the image forming portion 5, a scanner unit 8 that emits a laser beam based on image information to form an electrostatic latent image on the photosensitive drum 6, and developing apparatuses 9Y, 9M, 9C, and 9K that cause a toner to adhere to the electrostatic latent image to form a toner image, are arranged. Further, in the image forming portion 5, primary transfer portions 11Y, 11M, 11C, and 11K that transfer the toner image on the photosensitive drum 6 to a transfer belt 10 are arranged. Hereinafter, when the primary transfer portions 11Y, 11M, 11C, and 11K, as collectively referred to, are referred to as the primary transfer portion 11.

The toner image on the transfer belt 10 onto which the toner image has been transferred by the primary transfer portion 11 is transferred onto the recording material P by a secondary transfer portion 12. When passing through a fixing apparatus 100, the transferred image is fixed to the recording material P by pressure heat generated by a heating unit 101 and a pressure roller 102 pressed in contact with the heating unit 101. Thereafter, the conveyance path is switched by a double-sided flapper 13, and conveyed to a discharge roller pair 14 or a switchback roller pair 15. The recording material P conveyed to the switchback roller pair 15 side is reversely conveyed by the switchback roller pair 15. The recording material P passes through the registration roller 4, the secondary transfer portion 12, and the fixing apparatus 100 again, and is then conveyed to the discharge roller pair 14 side, so that double-sided printing is performed on the recording material P. Finally, after the recording material P passes through the discharge roller pair 14, the recording material P is discharged to a stacking portion 16. It is to be noted that, although a full-color laser beam printer provided with a plurality of photosensitive drums 6 has been described as an image forming apparatus, the present invention may also be applied to a fixing apparatus mounted on a monochrome copying machine or a printer that has a single photosensitive drum 6.

Fixing Apparatus

Figure 2:
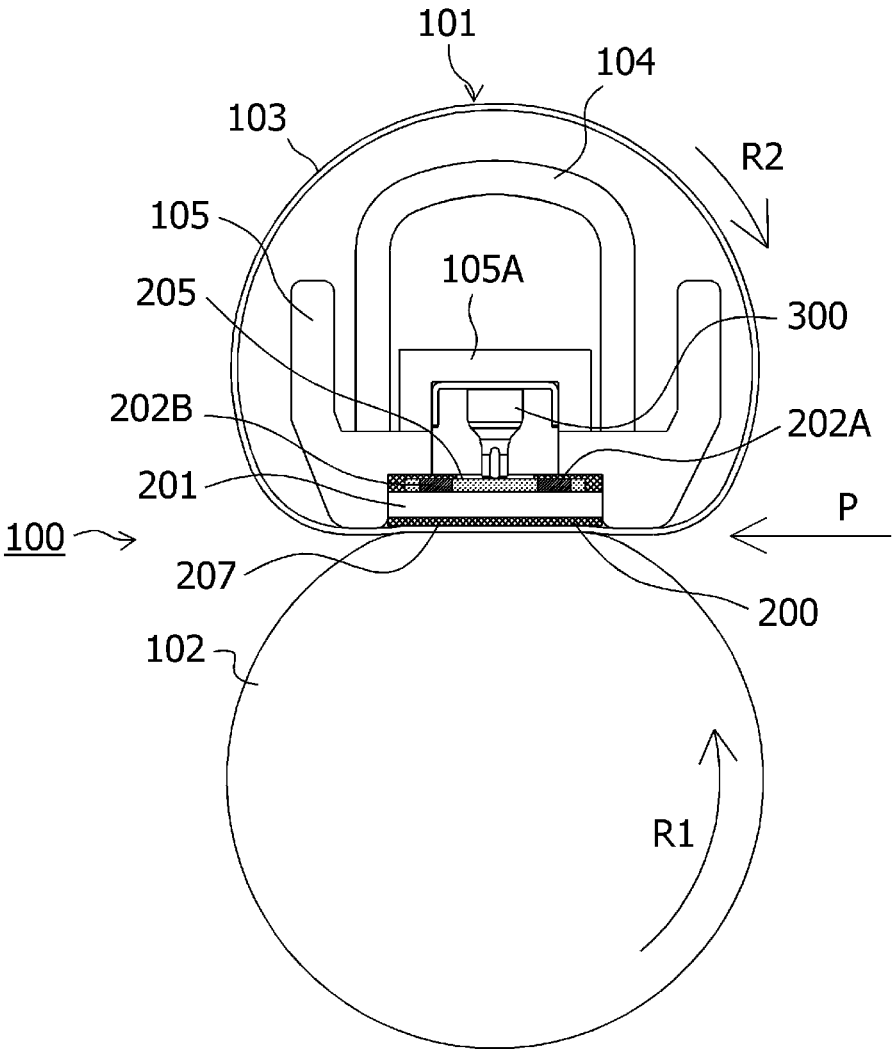
FIG. 2 is a cross-sectional view of a fixing nip according to the first embodiment.

Next, the fixing apparatus 100 according to the present embodiment will be described with reference to FIG. 2. The fixing apparatus (image heating apparatus) 100 is a fixing portion (image heating portion) that heats and fixes the toner image on the recording material P onto the recording material P. The fixing apparatus 100 includes the heating unit 101 and the pressure roller 102. FIG. 2 is a cross-sectional view of the fixing apparatus 100 including the heating unit 101 and the pressure roller 102. The heating unit 101 includes a tubular film 103, a heater 200 that comes into contact with the inner surface of the film 103 at a sliding layer 207, a holding member 105 that holds the heater 200, and a metal stay member 104. The holding member 105 is formed of a heat resistant resin such as a liquid crystal polymer. The stay member 104 serves to reinforce the holding member 105. The heater 200 includes heat generating elements 202A and 202B on the surface (hereinafter referred to as the back surface) opposite to the surface on which the sliding layer 207 of a substrate 201 is located, to transfer heat to the film 103 via the substrate 201 and the sliding layer 207. The heater 200 is arranged in the fixing apparatus 100 so that the longitudinal direction of the heater 200 extends in a direction orthogonal to the conveyance direction of the recording material P. It is to be noted that the longitudinal direction of the heater 200 is the same direction as the width direction of the recording material P. The pressure roller 102 includes a metal core portion and a rubber layer made of silicone rubber or the like. The holding member 105 is urged toward the pressure roller 102 side via the stay member 104 by pressing means (not illustrated). In other words, the heating unit 101 is urged toward the pressure roller 102 side, so that a fixing nip is formed by the heating unit 101 and the pressure roller 102. The pressure roller 102 is rotationally driven in a rotational direction R1 by a driving means (not illustrated), and the film 103 is rotationally driven in a rotational direction R2 as the pressure roller 102 rotates. The heating unit 101 includes an electrical contact part (power supply connector) 300. The electrical contact part 300 is held by a contact holding portion 105A of the holding member 105. The heater 200 generates heat with electric power supplied via the electrical contact part 300, and the toner image formed on the recording material P is heated using the heat of the heater 200. Details of the electrical contact part 300 will be described later.

Heater

Figure 3A:
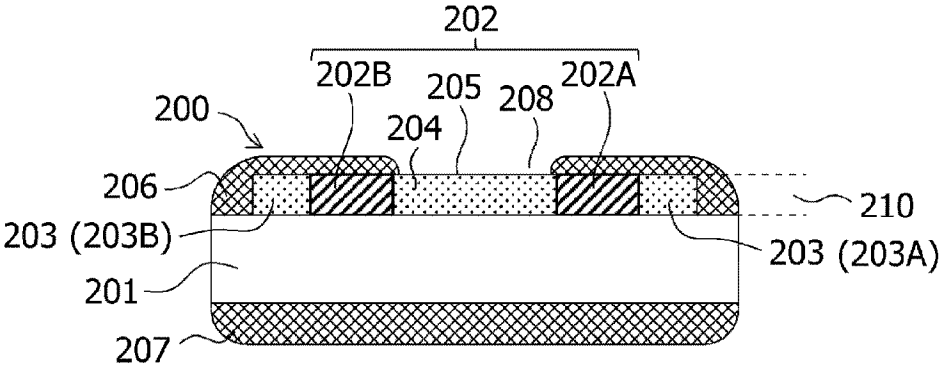
FIGS. 3A, 3B, and 3C are a cross-sectional view and plan views of a heater according to the first embodiment.

The heater 200 according to the present embodiment will be described with reference to FIGS. 3A to 3C. FIG. 3A is a cross-sectional view of the heater 200 in the short direction (conveyance direction of the recording material P). The heater 200 includes the elongated substrate 201 that is made of ceramics, and the heat generating elements 202A and 202B are provided in an energization layer 210 on the substrate 201. In the energization layer 210, a first conductor 203 and a second conductor 204 are provided along the longitudinal direction of the heater 200. The first conductor 203 includes first conductors 203A and 203B branched from the first conductor 203. The first conductors 203A and 203B are disposed on the upstream side and the downstream side in the conveyance direction of the recording material P, respectively. The second conductor 204 is disposed between the heat generating elements 202A and 202B. In the short direction of the heater 200, the first conductors 203A and 203B are arranged so that the heat generating elements 202A and 202B and the second conductor 204 are interposed between the first conductors 203A and 203B. In the arrangement example of FIG. 3A, the first conductor 203A, the heat generating element 202A, the second conductor 204, the heat generating element 202B, and the first conductor 203B are arranged in order from the upstream side to the downstream side in the conveyance direction of the recording material P. Further, an insulating protective layer 206 that covers the heat generating elements 202A and 202B, the first conductors 203A and 203B, and the second conductor 204 is provided on the back surface of the heater 200. On the sliding surface side on which the heater 200 slides on the film 103, the sliding layer 207 is provided by coating using glass or polyimide having good sliding properties.

Figure 3B:
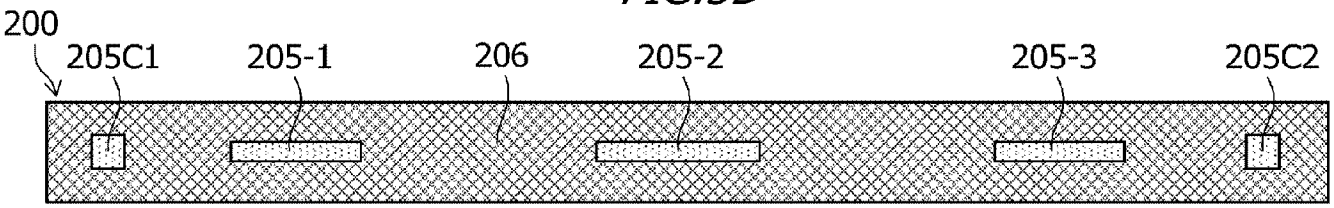
Figure 3C:
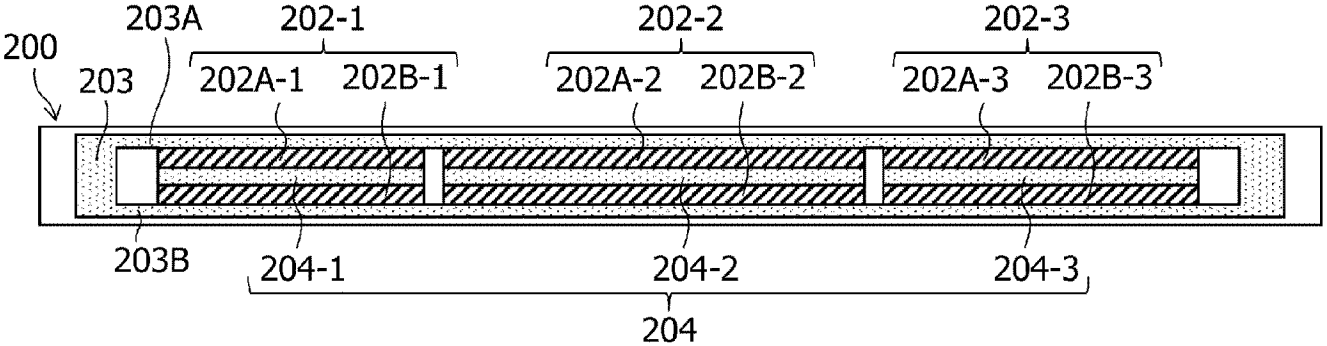

FIGS. 3B and 3C are plan views of the heater 200. In FIG. 3C, it is possible to see through the protective layer 206. The heater 200 includes a plurality of heat generation blocks (heating blocks) 202. The plurality of heat generation blocks 202 is arranged side by side in the longitudinal direction of the heater 200. The heater 200 of the present embodiment includes three heat generation blocks 202-1 to 202-3. The three heat generation blocks 202-1 to 202-3 are controllable independently of one another. The heat generation block 202-1 (first heat generation block) includes heat generating elements 202A-1 and 202B-1 that are formed symmetrically in the short direction of the heater 200. Similarly, the heat generation block 202-2 (second heat generation block) includes heat generating elements 202A-2 and 202B-2, and the heat generation block 202-3 (third heat generation block) includes heat generating elements 202A-3 and 202B-3. In the present embodiment, the heat generation blocks 202-1 to 202-3 are sometimes collectively referred to as the heat generation block 202. Further, at least one of the heat generation blocks 202-1 to 202-3 is sometimes referred to as the heat generation block 202.

The first conductor 203 is provided along the longitudinal direction of the heater 200. The first conductor 203 includes the first conductor 203A connected to the heat generating elements 202A-1, 202A-2 and 202A-3, and the first conductor 203B connected to the heat generating elements 202B-1, 202B-2 and 202B-3. The second conductor 204 includes second conductors 204-1, 204-2, and 204-3 connected to the heat generation blocks 202-1, 202-2, and 202-3, respectively. The second conductors 204-1, 204-2, and 204-3 are spaced apart from one another. In other words, the second conductor 204 is divided into the second conductors 204-1, 204-2, and 204-3.

Electrodes 205C1, 205C2, 205-1, 205-2, and 205-3 are exposed from a plurality of openings 208 provided in the protective layer 206. A part of each of the first conductor 203 and the second conductors 204-1, 204-2, 204-3 is exposed from the corresponding opening 208 of the protective layer 206, so that the electrodes 205C1, 205C2, 205-1, 205-2, and 205-3 are formed in the heater 200. The electrodes 205C1 and 205C2 are parts of the first conductor 203. The electrodes 205-1, 205-2, and 205-3 are parts of the second conductors 204-1, 204-2, and 204-3, respectively. The electrode 205-1 is an electrode for supplying electric power to the heat generation block 202-1. Similarly, the electrode 205-2 is an electrode for supplying electric power to the heat generation block 202-2, and the electrode 205-3 is an electrode for supplying electric power to the heat generation block 202-3. The electrode 205-1, 205-2 and 205-3 are electrically connected to the heat generation block 202-1, 202-2 and 202-3, respectively. The electrodes 205C1 and 205C2 are common electrodes for supplying electric power to the heat generation blocks 202-1 to 202-3 via the first conductors 203A and 203B. The electrodes 205C1 and 205C2 are electrically connected to the heat generation blocks 202-1 to 202-3. In the present embodiment, the electrodes 205-1 to 205-3 are sometimes collectively referred to as the electrode 205. Further, at least one of the electrodes 205-1 to 205-3 is sometimes referred to as the electrode 205. The electrode 205 is electrically connected to the heat generation block 202. The plurality of electrodes 205 is arranged side by side in the direction orthogonal to the conveyance direction of the recording material P.

The arrangement of the electrodes 205-1 to 205-3 spaced apart from one another makes it possible to independently control electric power supplied to at least one of the heat generation blocks 202-1 to 202-3 and electric power supplied to the other heat generation blocks 202. Independently setting the ratios of power supply to the heat generation blocks 202-1 to 202-3 makes it possible to provide a heat generation distribution suitable for the size of the recording material P so that a temperature rise (end-portion temperature rise) in a sheet non-passing region where the recording material P does not pass through can be suppressed. The heater 200 can selectively supply power to any heat generation block 202, which provides not only control of generating heat in each heat generation block depending on the size of the recording material P but also control of generating heat in each heat generation block depending on image information (e.g., so as to heat only an area corresponding to an image on the recording material P).

Electrical Contact Part—Power Supply Configuration—

Figure 4:
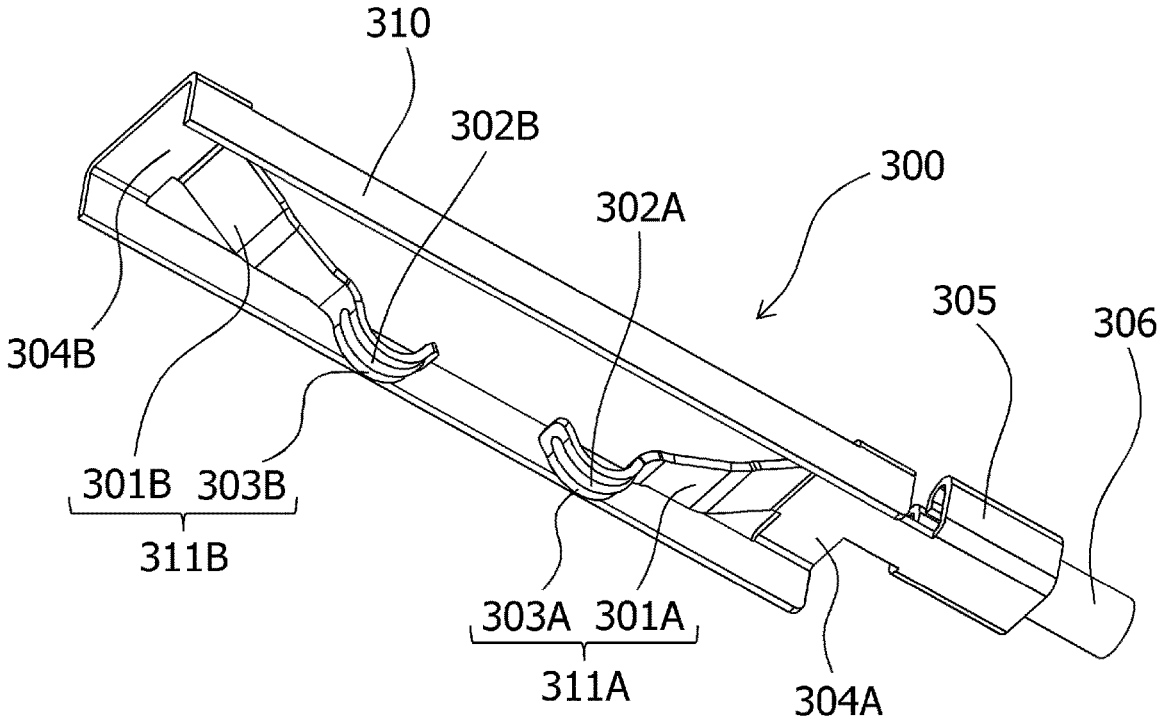
FIG. 4 is a perspective view of an electrical contact part according to the first embodiment.

The electrical contact part 300 for supplying electric power to the electrode 205 of the heater 200 illustrated in FIGS. 3A to 3C will be described with reference to FIG. 4. FIG. 4 is a perspective view of the electrical contact part 300 according to the present embodiment. The electrical contact part 300 is a pressed part processed by bending a metal plate, and includes a base portion (supporting portion) 310 and contact portions (terminal portions) 311A and 311B. The contact portion 311A is an example of a first contact portion. The contact portion 311B is an example of a second contact portion. The base portion 310 includes a first base portion 304A and a second base portion 304B that are not directly connected to each other. The first base portion 304A supports the contact portion 311A, and the second base portion 304B supports the contact portion 311B. The first base portion (first supporting portion) 304A and the second base portion (second supporting portion) 304B have a plate shape. The contact portion 311A includes an arm portion 301A and a contact base 303A. The arm portion 301A extends from the first base portion 304A, and the contact base 303A is provided at the tip of the arm portion 301A. An electrical contact portion 302A is formed at the central portion of the contact base 303A. The contact portion 311B includes an arm portion 301B and a contact base 303B. The arm portion 301B extends from the second base portion 304B, and the contact base 303B is provided at the tip of the arm portion 301B. An electrical contact portion 302B is formed at the central portion of the contact base 303B. The electrical contact portions 302A and 302B are portions that come into contact with the electrode 205.

The contact portion 311A supported by the first base portion 304A extends in a direction toward the second base portion 304B. The contact portion 311B supported by the second base portion 304B extends in a direction toward the first base portion 304A. The arm portion 301A and the arm portion 301B are bent and elastically deformable. The arm portion 301A and the arm portion 301B are examples of an elastically deformable portion. When the electrical contact part 300 is pressed against the heater 200, the arm portion 301A and the arm portion 301B are elastically deformed. The contact base 303A is pressed against the electrode 205 by the elastic force of the arm portion 301A generated when the arm portion 301A is elastically deformed. Accordingly, the electrical contact portion 302A is pressed against the electrode 205 with a predetermined load, and electrical contact is made between the electrical contact portion 302A and the electrode 205. The electrical contact portion 302A is an example of a first electrical contact portion. Further, the contact base 303A of the contact portion 311B is pressed against the electrode 205 by the elastic force of the arm portion 301B generated when the arm portion 301B is elastically deformed. Accordingly, the electrical contact portion 302B is pressed against the electrode 205 with a predetermined load, and electrical contact is made between the electrical contact portion 302B and the electrode 205. The electrical contact portion 302B is an example of a second electrical contact portion. The electrical contact portions 302A and 302B have R-shapes formed by drawing the contact bases 303A and 303B, respectively. The electrical contact part 300 is designed so that the electrical contact portions 302A and 302B come into point contact with the electrode 205 at the apex of the R-shape. The electrical contact portions 302A and 302B are pressed against the electrode 205 with a predetermined load so that the point contact portion is crushed a bit, thereby having good contact resistance.

The magnitude of the elastic force of the arm portion 301A is different from the magnitude of the elastic force of the arm portion 301B. In other words, the magnitude of the load when the electrical contact portion 302A is pressed against the electrode 205 is different from the magnitude of the load when the electrical contact portion 302B is pressed against the electrode 205. This is to prevent the electrical contact portions 302A and 302B from vibrating at the same frequency during vibration due to driving force or vibration caused when the recording material P passes through the fixing nip. This makes it possible to minimize the possibility of separating the electrical contact portions 302A and 302B from the electrode 205 at the same timing, for example, when resonance occurs so that the electrical contact portions 302A and 302B vibrate with a large amplitude. However, the magnitude of the elastic force of the arm portion 301A and the magnitude of the elastic force of the arm portion 301B may be equal. In the electrical contact part 300, an electric wire 306 is caulked at a caulking portion 305 so that the electrical contact part 300 is electrically connected to a power source via the electric wire 306.

Figure 5:
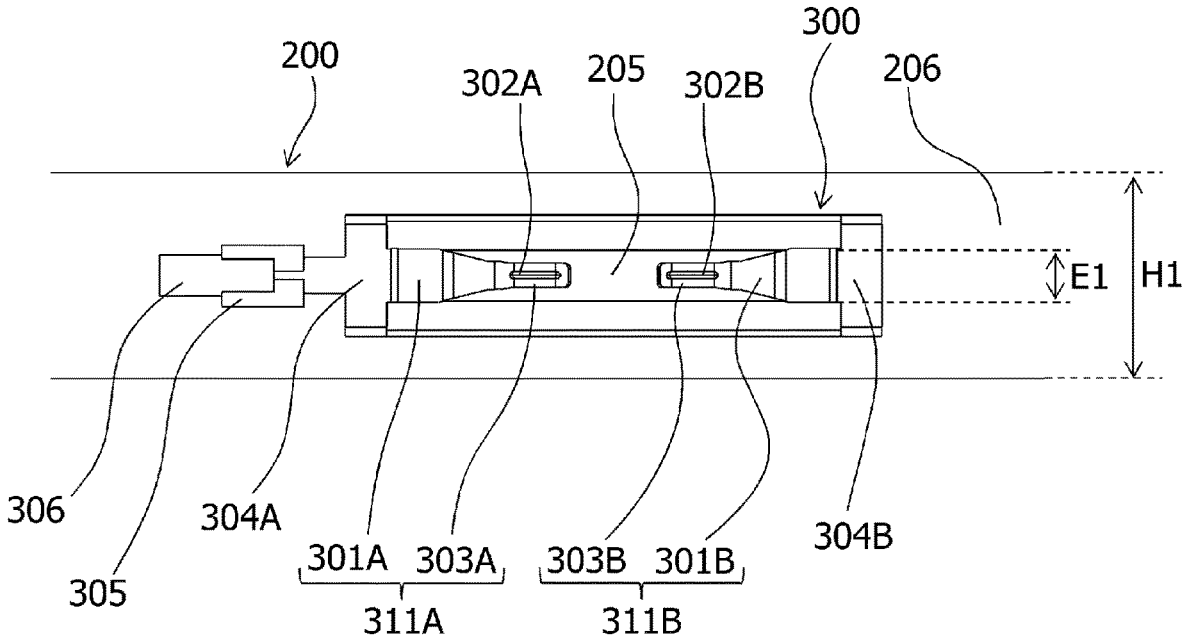
FIG. 5 is a plan view illustrating a positional relationship between the heater and the electrical contact part according to the first embodiment.

FIG. 5 is a plan view illustrating the positional relationship between the heater 200 and the electrical contact part 300 when viewed from the back surface side of the heater 200. As illustrated in FIG. 5, the contact portions 311A and 311B are in contact with one of the plurality of electrodes 205 provided in the heater 200. Further, the contact portions 311A and 311B are in contact with one of the plurality of electrodes 205 provided in the heater 200 at different positions. The electrical contact part 300 is placed so that the arm portion 301A and the arm portion 301B extend in a direction parallel to the longitudinal direction of the heater 200. Since the arm portions 301A and 301B have an arm shape, it is necessary to place the arm portions 301A and 301B in a region having a certain size. For example, when the electrical contact part 300 is placed so that the arm portions 301A and 301B extend in a direction orthogonal to the longitudinal direction of the heater 200, the electrical contact part 300 and the electric wire 306 interfere with the film 103. By contrast, placing the electrical contact part 300 as illustrated in FIG. 5 avoids that the electrical contact part 300 and the electric wire 306 interfere with the film 103.

The first base portion 304A and the second base portion 304B are arranged to be spaced apart from each other in the longitudinal direction of the heater 200. The contact portions 311A and 311B extend in the longitudinal direction of the heater 200, and the contact portion 311A and the contact portion 311B are arranged side by side in the longitudinal direction of the heater 200. That is, the contact portion 311A is arranged opposed to the contact portion 311B in the longitudinal direction of the heater 200. The contact base 303A having the electrical contact portion 302A and the contact base 303B having the electrical contact portion 302B are arranged at different positions in the longitudinal direction of the heater 200. This arrangement allows the contact bases 303A and 303B to be brought closer to each other in the longitudinal direction of the heater 200. As illustrated in FIG. 5, the contact base 303A having the electrical contact portion 302A and the contact base 303B having the electrical contact portion 302B are arranged side by side in the longitudinal direction of the heater 200. In the present embodiment, the contact bases 303A and 303B overlap when viewed from the longitudinal direction of the heater 200.

Figure 6:
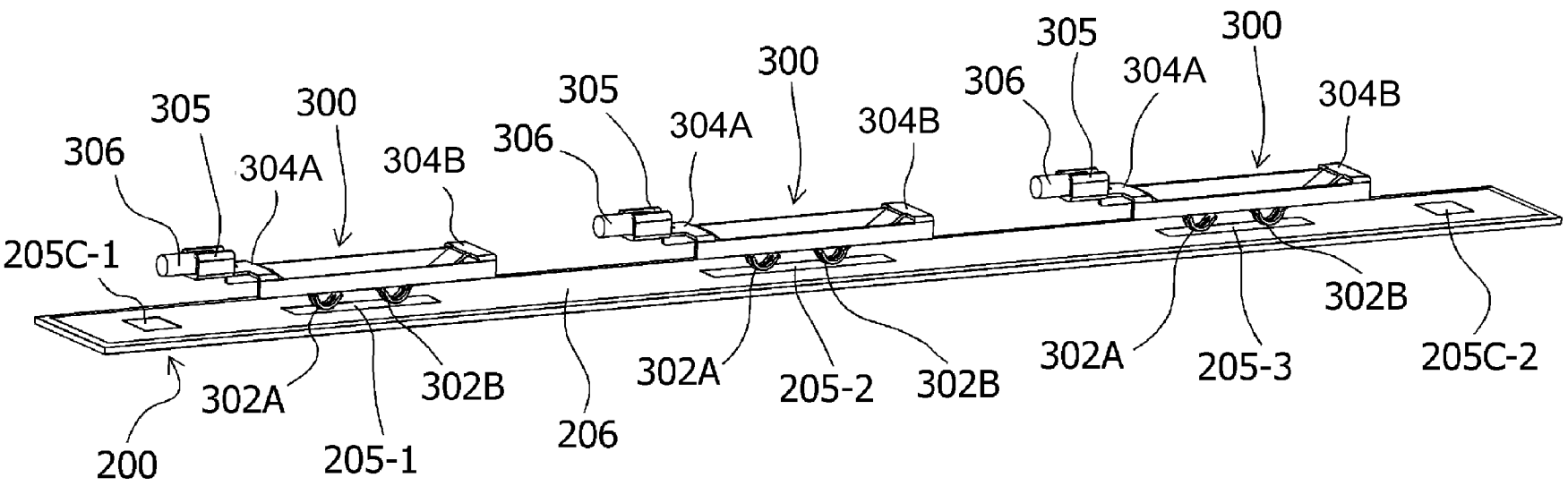
FIG. 6 is a perspective view illustrating a positional relationship between the heater and the electrical contact part according to the first embodiment.

FIG. 6 illustrates the arrangement of three electrical contact parts 300 side by side for the electrodes 205-1 to 205-3 provided at three places in the heater 200. As illustrated in FIG. 6, the three electrical contact parts 300 for supplying electric power, respectively, to the electrodes 205-1 to 205-3 are arranged on the heater 200. Supplying electric power from the electric wire 306 individually to the electrodes 205-1 to 205-3 via the three electrical contact parts 300 makes it possible to cause only the desired heat generation block 202 to be heated independently. It is to be noted that the electrical contact part 300 is held by the contact holding portion 105A of the holding member 105 illustrated in FIG. 2. When the three electrical contact parts 300 are used as in the present embodiment, three contact holding portions 105A are arranged at positions corresponding, respectively, to the electrodes 205-1 to 205-3, and the three electrical contact parts 300 are held by the three contact holding portions 105A, respectively.

As illustrated in FIG. 5, when the electrical contact part 300 is placed on the heater 200, the electrical contact portions 302A and 302B each have a width shorter than a width E1 of the electrode 205 in the short direction of the heater 200. Further, as illustrated in FIG. 5, when the electrical contact part 300 is placed on the heater 200, the electrical contact portions 302A and 302B are arranged side by side in the longitudinal direction of the heater 200. Therefore, even when the width E1 of the electrode 205 in the short direction of the heater 200 is short, the electrical contact portions 302A and 302B do not protrude from one electrode 205, and each of the electrical contact portions 302A and 302B can come into contact with the one electrode 205. This makes it possible to provide a highly reliable contact configuration against disturbances such as vibration and minute dust. In addition, setting the width E1 of the electrode 205 in the short direction of the heater 200 to be short makes it possible to set a width H1 of the heater 200 to be short. As a result, it is possible for the heater 200 to have a low heat capacity, thereby shortening the FPOT. Therefore, according to the present embodiment, it is possible to improve the reliability of the electrical contact in the fixing apparatus 100 and the electrical contact part 300 with the FPOT shortened.

Second Embodiment

A fixing apparatus according to the present embodiment will be described. In the present embodiment, the same portions/parts as those in the first embodiment are denoted by the same reference numerals, and description thereof will be not repeated. In the heater 200 of the first embodiment, the number of divided heat generating elements is three, while, in a heater 400 of the present embodiment, the number of divided heat generating elements is increased to five (blocks). Details of the present embodiment will be described.

Fixing Apparatus

Figure 7:
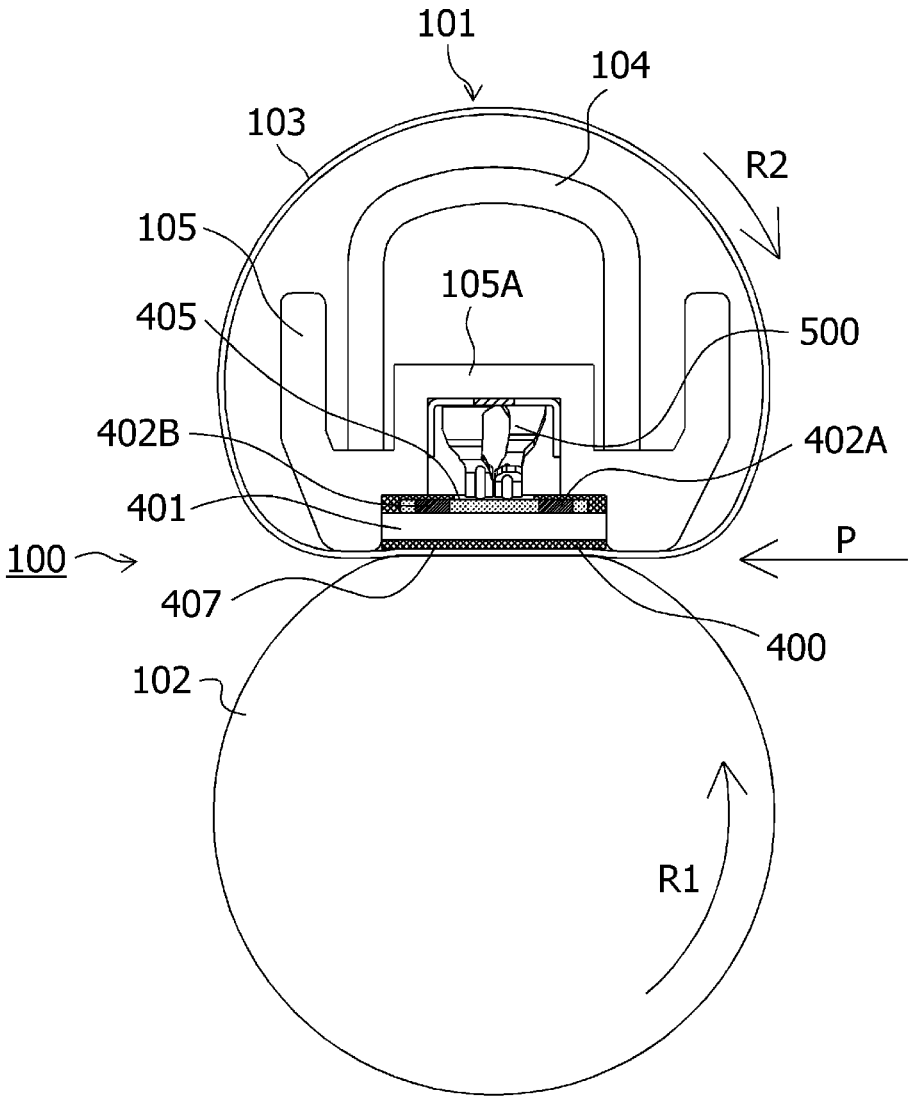
FIG. 7 is a cross-sectional view of a fixing nip according to a second embodiment.

FIG. 7 is a cross-sectional view of a fixing nip formed by the heating unit 101 and the pressure roller 102. The heating unit 101 includes the tubular film 103, a heater 400 that comes into contact with the inner surface of the film 103 at a sliding layer 407, the holding member 105 that holds the heater 400, and the metal stay member 104. The heater 400 includes heat generating elements 402A and 402B on the surface (hereinafter referred to as the back surface) opposite to the film 103 across a substrate 401, to transfer heat to the film 103 via the substrate 401 and the sliding layer 407. The heater 400 is arranged in the fixing apparatus 100 so that the longitudinal direction of the heater 400 extends in a direction orthogonal to the conveyance direction of the recording material P. It is to be noted that the longitudinal direction of the heater 400 is the same direction as the width direction of the recording material P. The heating unit 101 includes an electrical contact part (power supply connector) 500. The electrical contact part 500 is held by the contact holding portion 105A of the holding member 105. Details of the electrical contact part 500 will be described later.

Heater

Figure 8A:
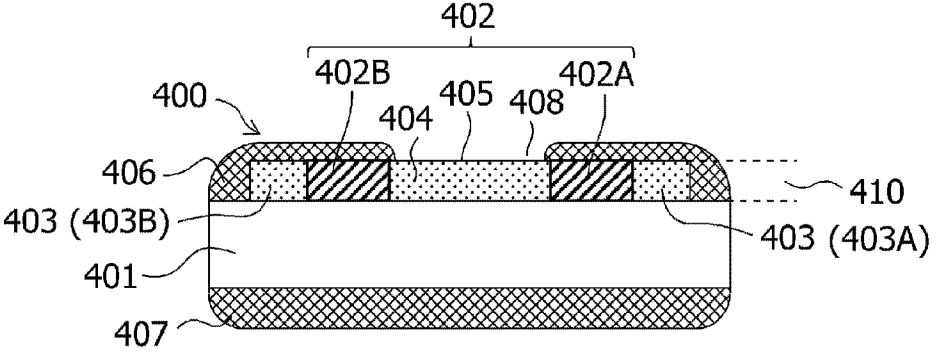
FIGS. 8A, 8B, and 8C are a cross-sectional view and plan views of a heater according to the second embodiment.

The heater 400 according to the present embodiment will be described with reference to FIGS. 8A to 8C. FIG. 8A is a cross-sectional view of the heater 400 in the short direction (conveyance direction of the recording material P). The heater 400 is heated by the heat generating elements 402A and 402B provided on an energization layer 410 on the substrate 401 that is made of ceramics. In the energization layer 410, a first conductor 403 and a second conductor 404 are provided along the longitudinal direction of the heater 400. The first conductor 403 includes first conductors 403A and 403B branched from the first conductor 403. The first conductors 403A and 403B are disposed on the upstream side and the downstream side in the conveyance direction of the recording material P, respectively. The second conductor 404 is disposed between the heat generating elements 402A and 402B. In the short direction of the heater 400, the first conductors 403A and 403B are arranged so that the heat generating elements 402A and 402B and the second conductor 404 are interposed between the first conductors 403A and 403B. In the arrangement example of FIG. 8A, the first conductor 403A, the heat generating element 402A, the second conductor 404, the heat generating element 402B, and the first conductor 403B are arranged in order from the upstream side to the downstream side in the conveyance direction of the recording material P. Further, an insulating protective layer 406 that covers the heat generating elements 402A and 402B, the first conductors 403A and 403B, and the second conductor 404 is provided on the back surface of the heater 400. On the sliding surface side on which the heater 400 slides on the film 103, the sliding layer 407 is provided by coating using glass or polyimide having good sliding properties. The heater 400 also includes a heat generation block 402 including the heat generating elements 402A and 402B.

Figure 8B:
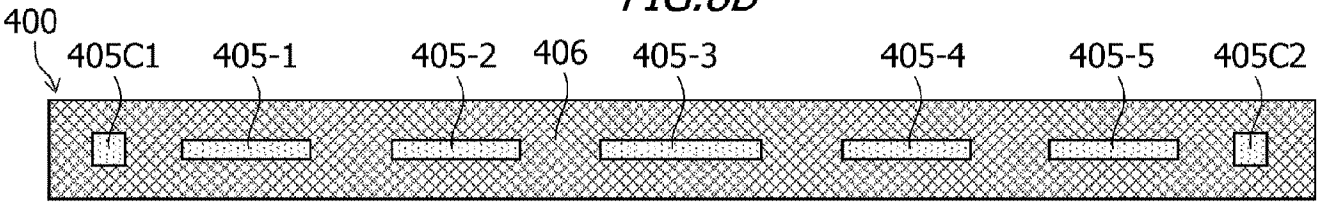
Figure 8C:
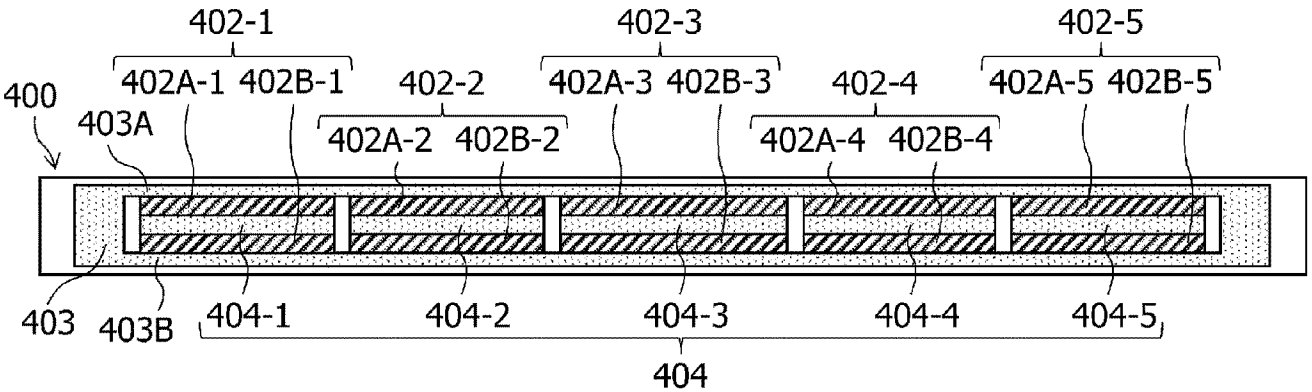

FIGS. 8B and 8C are plan views of the heater 400. In FIG. 8C, it is possible to see through the protective layer 406. The heater 400 includes a plurality of heat generation blocks 402. The plurality of heat generation blocks 402 is arranged side by side in the longitudinal direction of the heater 400. The heater 400 of the present embodiment includes five heat generation blocks 402-1 to 402-5. The five heat generation blocks 402-1 to 402-5 are controllable independently of one another. The heat generation block 402-1 (first heat generation block) includes heat generating elements 402A-1 and 402B-1 that are formed symmetrically in the short direction of the heater 400. Similarly, the heat generation block 402-2 (second heat generation block) includes heat generating elements 402A-2 and 402B-2, and the heat generation block 402-3 (third heat generation block) includes heat generating elements 402A-3 and 402B-3. Furthermore, the heat generation block 402-4 (fourth heat generation block) includes heat generating elements 402A-4 and 402B-4, and the heat generation block 402-5 (fifth heat generation block) includes heat generating elements 402A-5 and 402B-5. In the present embodiment, the heat generation blocks 402-1 to 402-5 are sometimes collectively referred to as the heat generation block 402. Further, at least one of the heat generation blocks 402-1 to 402-5 is sometimes referred to as the heat generation block 402.

The first conductor 403 is provided along the longitudinal direction of the heater 400. The first conductor 403 includes the first conductor 403A connected to the heat generating elements 402A-1 to 402A-5, and the first conductor 403B connected to the heat generating elements 402B-1 to 402B-5. The second conductor 404 includes second conductors 404-1 to 404-5 connected to the heat generation blocks 402-1 to 402-5, respectively. The second conductors 404-1 to 404-5 are spaced apart from one another. In other words, the second conductor 404 is divided into the second conductors 404-1 to 404-5.

Electrodes 405C1, 405C2, and 405-1 to 405-5 are exposed from a plurality of openings 408 provided in the protective layer 406. A part of each of the first conductor 403 and the second conductors 404-1 to 404-5 is exposed from the corresponding opening 408 of the protective layer 406, so that the electrodes 405C1, 405C2, and 405-1 to 405-5 are formed in the heater 400. The electrodes 405C1 and 405C2 are part of the first conductor 403. The electrodes 405-1 to 405-5 are parts of the second conductors 404-1 to 404-5, respectively. The electrode 405-1 is an electrode for supplying electric power to the heat generation block 402-1. Similarly, the electrode 405-2 is an electrode for supplying electric power to the heat generation block 402-2, and the electrode 405-3 is an electrode for supplying electric power to the heat generation block 402-3. The electrode 405-4 is an electrode for supplying electric power to the heat generation block 402-4, and the electrode 405-5 is an electrode for supplying electric power to the heat generation block 402-5. The electrode 405-1, 405-2, 405-3, 405-4 and 405-5 are electrically connected to the heat generation block 402-1, 402-2, 402-3, 402-4 and 402-5, respectively. The electrodes 405C1 and 405C2 are common electrodes for supplying electric power to the heating blocks 402-1 to 402-5 via the first conductors 403A and 403B. The electrodes 405C1 and 405C2 are electrically connected to the heat generation block 402-1 to 402-5. In the present embodiment, the electrodes 405-1 to 405-5 are sometimes collectively referred to as the electrode 405. Further, at least one of the electrodes 405-1 to 405-5 is sometimes referred to as the electrode 405. The electrode 405 is electrically connected to the heat generation block 402. The plurality of electrodes 405 is arranged side by side in the direction orthogonal to the conveyance direction of the recording material P.

The arrangement of the electrodes 405-1 to 405-5 spaced apart from one another makes it possible to independently control electric power supplied to at least one of the heat generation blocks 402-1 to 402-5 and electric power supplied to the other heat generation blocks 402. Independently setting the ratios of power supply to the heat generation blocks 402-1 to 402-5 makes it possible to provide a heat generation distribution suitable for the size of the recording material P so that a temperature rise (end-portion temperature rise) in a sheet non-passing region where the recording material P does not pass through can be suppressed. In addition, electric power can be supplied only to the heat generation blocks 402-2 to 402-4. Thus, using the heater 400 of the present embodiment makes it possible to control the heated region more finely as compared to the heater 200 of the first embodiment, thereby increasing types of size of the recording material P to which suppression of the end-portion temperature rise in the sheet non-passing region is applicable.

Electrical Contact Part—Power Supply Configuration—

Figure 9:
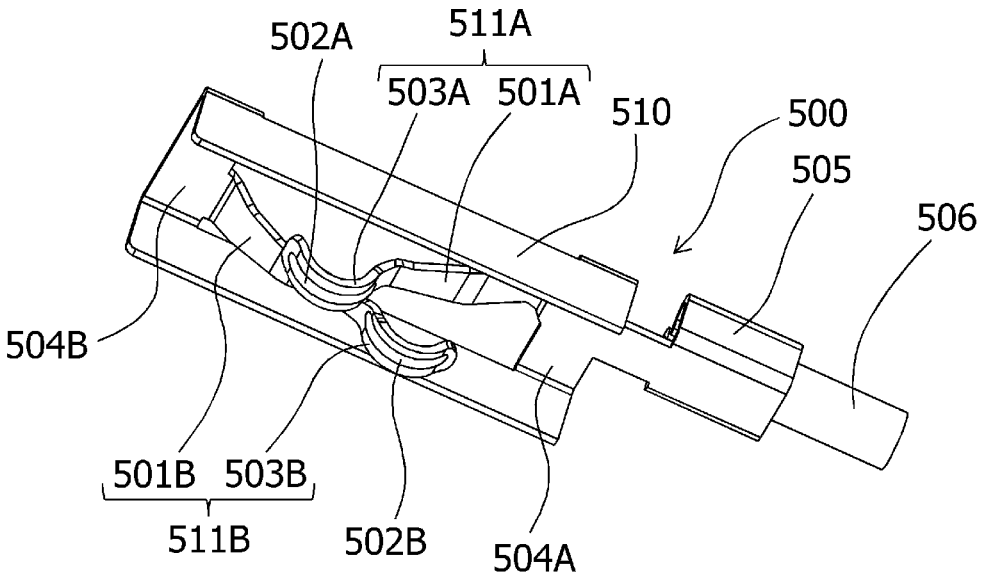
FIG. 9 is a perspective view of an electrical contact part according to the second embodiment.

The electrical contact part 500 for supplying electric power to the electrode 405 of the heater 400 illustrated in FIGS. 8A to 8C will be described with reference to FIG. 9. FIG. 9 is a perspective view of the electrical contact part 500 according to the present embodiment. The electrical contact part 500 is a pressed part processed by bending a metal plate, and includes a base portion (supporting portion) 510 and contact portions (terminal portions) 511A and 511B. The contact portion 511A is an example of the first contact portion. The contact portion 511B is an example of the second contact portion. The base portion 510 includes a first base portion 504A and a second base portion 504B that are not directly connected to each other. The first base portion 504A supports the contact portion 511A, and the second base portion 504B supports the contact portion 511B. The first base portion 504A and the second base portion 504B may be formed in a plate shape. The first base portion 504A is an example of the first supporting portion. The second base portion 504B is an example of the second supporting portion. The contact portion 511A includes an arm portion 501A and a contact base 503A. The arm portion 501A extends from the first base portion 504A, and the contact base 503A is provided at the tip of the arm portion 501A. An electrical contact portion 502A (first electrical contact portion) is formed at the central portion of the contact base 503A. The contact portion 511B includes an arm portion 501B and a contact base 503B. The arm portion 501B extends from the second base portion 504B, and the contact base 503B is provided at the tip of the arm portion 501B. An electrical contact portion 502B (second electrical contact portion) is formed at the central portion of the contact base 503B. The electrical contact portions 502A and 502B are portions that come into contact with the electrode 405.

The contact portion 511A supported by the first base portion 504A extends in a direction toward the second base portion 504B. The contact portion 511B supported by the second base portion 504B extends in a direction toward the first base portion 504A. When the electrical contact part 500 is pressed against the heater 400, the arms 501A and 501B are elastically deformed. The contact base 503A of the contact portion 511A is pressed against the electrode 405 by the elastic force of the arm portion 501A generated when the arm portion 501A is elastically deformed. Accordingly, the electrical contact portion 502A is pressed against the electrode 405 with a predetermined load, and electrical contact is made between the electrical contact portion 502A and the electrode 405. Further, the contact base 503B of the contact portion 511B is pressed against the electrode 405 by the elastic force of the arm portion 501B generated when the arm portion 501B is elastically deformed. Thus, the electrical contact portion 502B is pressed against the electrode 405 with a predetermined load, and electrical contact is made between the electrical contact portion 502B and the electrode 405. The electrical contact portions 502A and 502B have R-shapes formed by drawing the contact bases 503A and 503B, respectively. The electrical contact part 500 is designed so that the electrical contact portions 502A and 502B come into point contact with the electrode 405 at the apex of the R-shape. The electrical contact portions 502A and 502B are pressed against the electrode 405 with a predetermined load so that the point contact portion is crushed a bit, thereby having good contact resistance.

The magnitude of the elastic force of the arm portion 501A is different from the magnitude of the elastic force of the arm portion 501B. In other words, the magnitude of the load when the electrical contact portion 502A is pressed against the electrode 405 is different from the magnitude of the load when the electrical contact portion 502B is pressed against the electrode 405. This is to prevent the electrical contact portions 502A and 502B from vibrating at the same frequency during vibration due to driving force or vibration caused when the recording material P passes through the fixing nip. This makes it possible to minimize the possibility of separating the electrical contact portions 502A and 502B from the electrode 405 at the same timing, for example, when resonance occurs so that the electrical contact portions 502A and 502B vibrate with a large amplitude. However, the magnitude of the elastic force of the arm portion 501A and the magnitude of the elastic force of the arm portion 501B may be equal. In the electrical contact part 500, an electric wire 506 is caulked at a caulking portion 505 so that the electrical contact part 500 is electrically connected to a power source via the electric wire 506.

Figure 10:
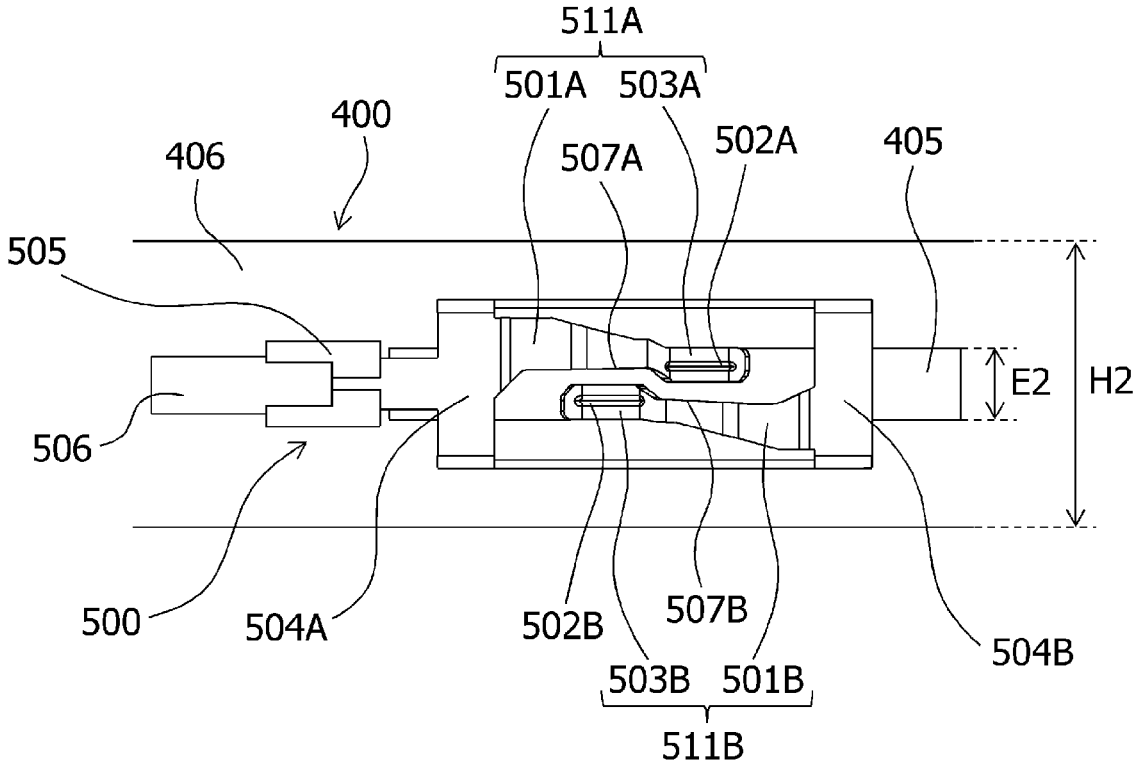
FIG. 10 is a plan view illustrating a positional relationship between a heater and the electrical contact part according to the second embodiment.

FIG. 10 is a plan view illustrating the positional relationship between the heater 400 and the electrical contact part 500 when viewed from the back surface side of the heater 400. As illustrated in FIG. 10, the contact portions 511A and 511B are in contact with one of the plurality of electrodes 405 provided in the heater 400. Further, the contact portions 511A and 511B are in contact with one of the plurality of electrodes 405 provided in the heater 400 at different positions. The electrical contact part 500 is placed so that the arm portion 501A and the arm portion 501B extend in a direction parallel to the longitudinal direction of the heater 400. Since the arm portions 501A and 501B have an arm shape, it is necessary to place the arm portions 501A and 501B in a region having a certain size. For example, when the electrical contact part 500 is arranged so that the arm portions 501A and 501B extend in a direction orthogonal to the longitudinal direction of the heater 400, the electrical contact part 500 and the electric wire 506 interfere with the film 103. By contrast, placing the electrical contact part 500 as illustrated in FIG. 10 avoids that the electrical contact part 500 and the electric wire 506 interfere with the film 103.

The first base portion 504A and the second base portion 504B are arranged to be spaced apart from each other in the longitudinal direction of the heater 400. The contact portions 511A and 511B extend in the longitudinal direction of the heater 400, and the contact portion 511A and the contact portion 511B are arranged side by side in the short direction of the heater 400. The arm portion 501A includes a recessed portion 507A that is provided between the contact base 503A and the first base portion 504A and recessed in the short direction of the heater 400 and away from the contact base 503B. Similarly, the arm portion 501B includes a recessed portion 507B that is provided between the contact base 503B and the second base portion 504B and recessed in the short direction of the heater 400 and away from the contact base 503A. That is, the arm portion 501A includes the recessed portion 507A, and the arm portion 501B includes the recessed portion 507B. The recessed portion 507A is an example of a first recessed portion. The recessed portion 507B is an example of a second recessed portion. The recessed portion 507A and the contact base 503B are arranged side by side in the short direction of the heater 400. The recessed portion 507B and the contact base 503A are arranged side by side in the short direction of the heater 400. When viewed from the short direction of the heater 400, the position of the recessed portion 507A and the position of the contact base 503B overlap, and the position of the recessed portion 507B and the position of the contact base 503A overlap. The contact base 503A is not in contact with the arm portion 501B, the contact base 503B, and the recessed portion 507B. The contact base 503B is not in contact with the arm portion 501A, the contact base 503A, and the recessed portion 507A. This positional relationship in which the recessed portions 507A and 507B are recessed in the short direction of the heater 400 makes it possible to place the contact base 503B closer to the contact portion 511A side and place the contact base 503A closer to the contact portion 511B side. Accordingly, the contact base 503A and the contact base 503B can be brought closer to each other in the short direction of the heater 400, without the arm portion 501A and the contact base 503B being in contact with each other, and without the arm portion 501B and the contact base 503A being in contact with each other. Further, when viewed from the short direction of the heater 400, the position of the arm portion 501A and the position of the contact base 503B overlap, and the position of the arm portion 501B and the position of the contact base 503A overlap. This makes it possible to shorten the dimension of the electrical contact part 500 in the longitudinal direction of the heater 400.

The arm portion 501A may be curved in the short direction of the heater 400 and away from the contact base 503B. The arm portion 501B may be curved in the short direction of the heater 400 and away from the contact base 503A. The curved portion (first curved portion) of the arm portion 501A and the contact base 503A may be arranged side by side in the short direction of the heater 400. The curved portion (second curved portion) of the arm portion 501B and the contact base 503B may be arranged side by side in the short direction of the heater 400. Accordingly, when viewed from the short direction of the heater 400, the position of the curved portion of the arm portion 501A and the position of the contact base 503B overlap, and the position of the curved portion of the arm portion 501B and the position of the contact base 503A overlap. Thus, the contact base 503A and the contact base 503B can be brought closer to each other in the short direction of the heater 400, without the arm portion 501A and the contact base 503B being in contact with each other, and without the arm portion 501B and the contact base 503A being in contact with each other.

Figure 11:
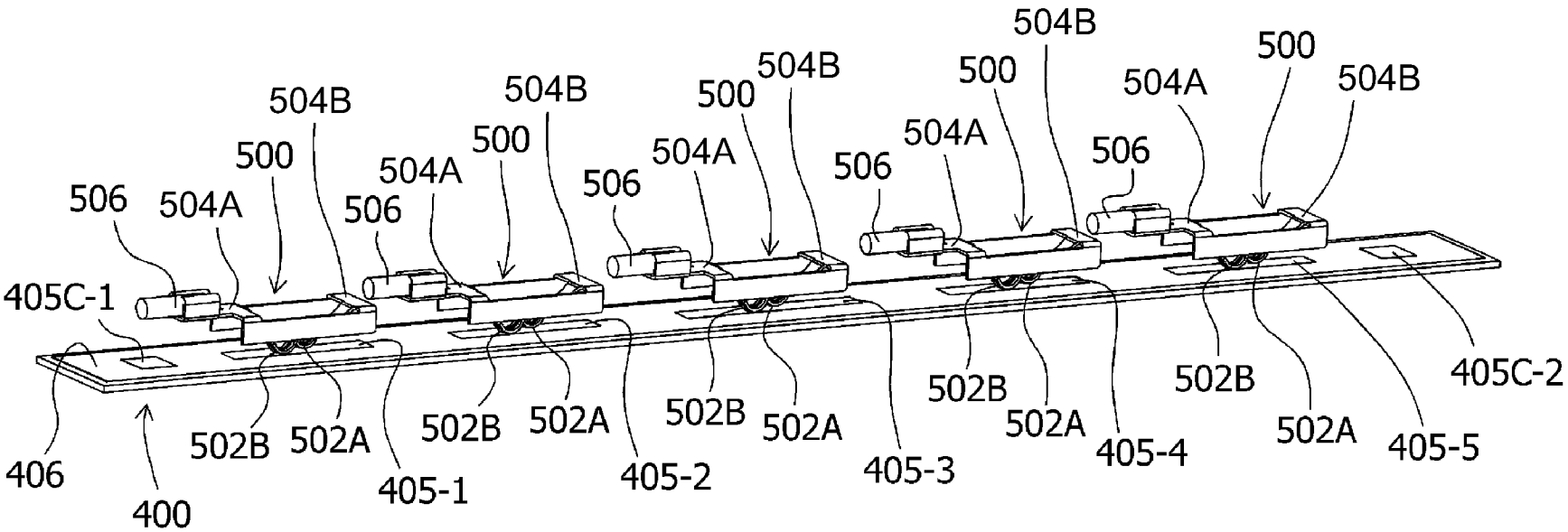
FIG. 11 is a perspective view illustrating a positional relationship between the heater and the electrical contact part according to the second embodiment.

FIG. 11 illustrates the arrangement of five electrical contact parts 500 side by side for the electrodes 405-1 to 405-5 provided at five places in the heater 400. As illustrated in FIG. 11, the five electrical contact parts 500 for supplying electric power, respectively, to the electrodes 405-1 to 405-5 are arranged on the heater 400. Supplying electric power from the electric wire 506 individually to the electrodes 405-1 to 405-5 via the five electrical contact parts 500 makes it possible to cause only the desired heat generation block 402 to be heated independently. The heater 400 of the present embodiment has a larger number of divided heat generating elements as compared to the first embodiment, and therefore the electrodes 405 are densely arranged in the heater 400. As described above, the electrical contact part 500 has a short dimension in the longitudinal direction of the heater 400, and even if one electrical contact part 500 is placed for each of the electrodes 405-1 to 405-5, the electrical contact parts 500 can be placed without interfering with each other. It is to be noted that the electrical contact part 500 is held by the contact holding portion 105A of the holding member 105 illustrated in FIG. 7. When the five electrical contact parts 500 are used as in the present embodiment, five contact holding portions 105A are arranged at positions corresponding, respectively, to the electrodes 405-1 to 405-5, and the five electrical contact parts 500 are held by the five contact holding portions 105A, respectively.

As illustrated in FIG. 10, when the electrical contact part 500 is placed on the heater 400, the electrical contact portions 502A and 502B each have a width shorter than a width E2 of the electrode 405 in the short direction of the heater 400. Further, the contact portions 502A and 502B are arranged so that, when viewed from the short direction of the heater 400, the position of the recessed portion 507A and the position of the contact base 503B overlap, and the position of the recessed portion 507B and the position of the contact base 503A overlap. Therefore, even when the width E2 of the electrode 405 in the short direction of the heater 400 is short, the electrical contact portions 502A and 502B do not protrude from one electrode 405, and each of the electrical contact portions 502A and 502B can come into contact with the one electrode 405. This makes it possible to provide a highly reliable contact configuration against disturbances such as vibration and minute dust. In addition, setting the width E2 of the electrode 405 in the short direction of the heater 400 to be short makes it possible to set a width H2 of the heater 400 to be short. As a result, it is possible for the heater 400 to have a low heat capacity, thereby shortening the FPOT. Therefore, according to the present embodiment, it is possible to improve the reliability of the electrical contact in the fixing apparatus 100 and the electrical contact part 500 with the FPOT shortened. Furthermore, according to the present embodiment, since the size of the electrical contact part 500 in the longitudinal direction of the heater 400 can be reduced, the number of blocks into which the heater 400 is divided can be increased, and accordingly, the end-portion temperature rise in the sheet non-passing region can be suppressed for more types of sizes of the recording material P.

Modification of Second Embodiment

Figure 12:
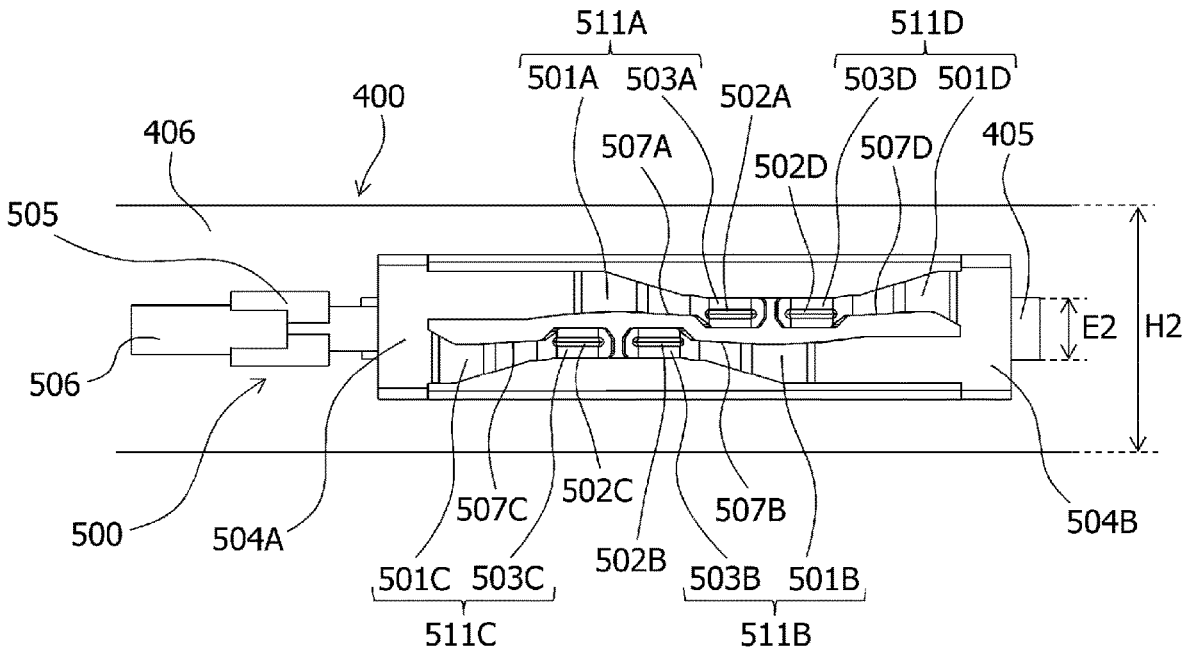
FIG. 12 is a plan view illustrating a positional relationship between a heater and an electrical contact part according to a modification of the second embodiment.
Figure 13:
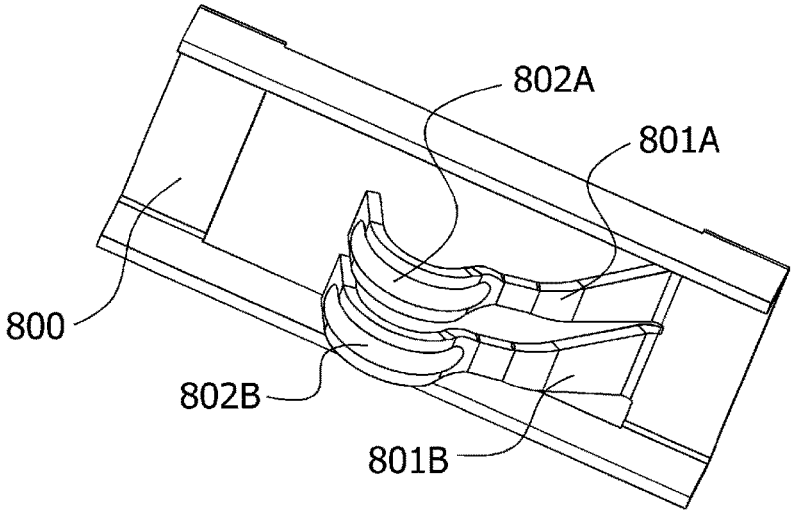
FIG. 13 is an explanatory diagram of a conventional electrical contact part.

As illustrated in FIG. 12, the electrical contact part 500 may include contact portions 511C and 511D as well as the contact portions 511A and 511B. The contact portion 511C is an example of a third contact portion. The contact portion 511D is an example of a fourth contact portion. FIG. 12 is a plan view illustrating the positional relationship between the heater 400 and the electrical contact part 500 when viewed from the back surface side of the heater 400. As illustrated in FIG. 12, the contact portions 511A to 511D are in contact with one of the plurality of electrodes 405 provided in the heater 400. Further, the contact portions 511A to 511D are in contact with one of the plurality of electrodes 405 provided in the heater 400 at different positions. The first base portion 504A supports the contact portions 511A and 511C, and the second base portion 504B supports the contact portions 511B and 511D. The contact portion 511C includes an arm portion 501C and a contact base 503C. The arm portion 501C extends from the first base portion 504A, and the contact base 503C is provided at the tip of the arm portion 501C. An electrical contact portion 502C is formed at the central portion of the contact base 503C. The contact portion 511D includes an arm portion 501D and a contact base 503D. The arm portion 501D extends from the second base portion 504B, and the contact base 503D is provided at the tip of the arm portion 501D. An electrical contact portion 502D is formed at the central portion of the contact base 503D. The electrical contact portions 502C and 502D are portions that come into contact with the electrode 405. However, a portion other than the central portion of the contact base 503C may come into contact with the electrode 405, and a portion other than the central portion of the contact base 503D may come into contact with the electrode 405.

The contact portion 511C supported by the first base portion 504A extends in a direction toward the second base portion 504B. The contact portion 511D supported by the second base portion 504B extends in a direction toward the first base portion 504A. The contact portion 511A and the contact portion 511D are arranged side by side in the longitudinal direction of the heater 400. The contact portion 511B and the contact portion 511C are arranged side by side in the longitudinal direction of the heater 400. The arm portions 501C and 501D are bent and elastically deformable. The arm portions 501C and 501D are examples of an elastically deformable portion. When the electrical contact part 500 is pressed against the heater 400, the arm portions 501C and 501D are elastically deformed. The contact base 503C of the contact portion 511C is pressed against the electrode 405 by the elastic force of the arm portion 501C generated when the arm portion 501C is elastically deformed. Accordingly, the electrical contact portion 502C is pressed against the electrode 405 with a predetermined load, and electrical contact is made between the electrical contact portion 502C and the electrode 405. The electrical contact portion 502C is an example of a third electrical contact portion. Further, the contact base 503D of the contact portion 511D is pressed against the electrode 405 by the elastic force of the arm portion 501D generated when the arm portion 501D is elastically deformed. Accordingly, the electrical contact portion 502D is pressed against the electrode 405 with a predetermined load, and electrical contact is made between the electrical contact portion 502D and the electrode 405. The electrical contact portion 502D is an example of a fourth electrical contact portion. The electrical contact portions 502C and 502D have R-shapes formed by drawing the contact bases 503C and 503D, respectively. Accordingly, the electrical contact portions 502C and 502D can come into point contact with the electrode 405 at the apex of the R-shape, and the electrical contact portions 502C and 502D are pressed against the electrode 405 with a predetermined load so that the point contact portion is crushed a bit, thereby having good contact resistance.

The magnitudes of the elastic forces of the arm portions 501A to 501D are different from one another. Accordingly, the magnitudes of the loads when the electrical contact portions 502A to 502D are pressed against the electrode 405 are different from one another. This makes it possible to minimize the possibility of separating the electrical contact portions 502A to 502D from the electrode 405 at the same timing, for example, when resonance occurs so that the electrical contact portions 502A to 502D vibrate with a large amplitude. However, the magnitudes of the elastic forces of the arm portions 501A to 501D may be equal.

The recessed portion 507A and the contact base 503C are arranged side by side in the short direction of the heater 400. The recessed portion 507B and the contact base 503D are arranged side by side in the short direction of the heater 400. When viewed from the short direction of the heater 400, the position of the recessed portion 507A and the position of the contact base 503C overlap, and the position of the recessed portion 507B and the position of the contact base 503D overlap. The contact base 503C is not in contact with the arm portion 501A, the contact base 503A, and the recessed portion 507A. The contact base 503D is not in contact with the arm portion 501B, the contact base 503B, and the recessed portion 507B. This positional relationship in which the recessed portions 507A and 507B are recessed in the short direction of the heater 400 makes it possible to place the contact base 503C closer to the contact portion 511A side and place the contact base 503D closer to the contact portion 511B side. In the short direction of the heater 400, the contact base 503B and the contact base 503C can be brought closer to each other without the arm portion 501A and the contact base 503C being in contact with each other. Further, in the short direction of the heater 400, the contact base 503A and the contact base 503D can be brought closer to each other without the arm portion 501B and the contact base 503D being in contact with each other. As described above, the arm portion 501A may be curved in the short direction of the heater 400 and away from the contact base 503B. The arm portion 501B may be curved in the short direction of the heater 400 and away from the contact base 503A. According to the modification of the present embodiment, when the width E2 of the electrode 405 in the short direction of the heater 400 is set to be short and the width H2 of the heater 400 is set to be short, it is possible to increase the number of electrical contacts for one electrode 405.

Third Embodiment

Next, a third embodiment of the present invention will be described. The same portions/parts as those in the second embodiment are denoted by the same reference numerals, and description thereof will be not repeated.

Electrical Contact Part—Power Supply Configuration—

Figure 14:
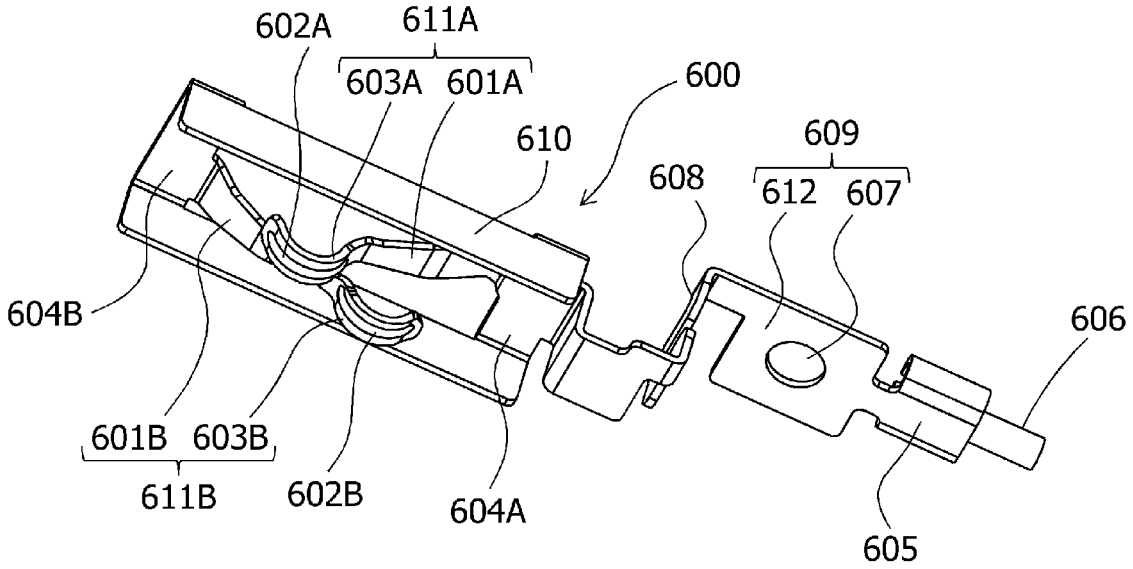
FIG. 14 is a perspective view of an electrical contact part according to a third embodiment.

An electrical contact part 600 connected to the electrode 405 of the heater 400 illustrated in FIGS. 8A to 8C to supply electric power to the electrode 405 will be described with reference to FIGS. 14 and 15. FIG. 14 is a perspective view of the electrical contact part 600 according to the present embodiment. The electrical contact part 600 is a pressed part processed by bending a metal plate, and includes a base portion (supporting portion) 610 and contact portions (terminal portions) 611A and 611B. The base portion 610 includes a first base portion 604A and a second base portion 604B that are not directly connected to each other. The first base portion 604A supports the contact portion 611A, and the second base portion 604B supports the contact portion 611B. The first base portion 604A and the second base portion 604B have a plate shape. The contact portion 611A includes an arm portion 601A and a contact base 603A. The arm portion 601A extends from the first base portion 604A, and the contact base 603A is provided at the tip of the arm portion 601A. An electrical contact portion 602A is formed at the central portion of the contact base 603A. The contact portion 611B includes an arm portion 601B and a contact base 603B. The arm portion 601B extends from the second base portion 604B, and the contact base 603B is provided at the tip of the arm portion 601B. An electrical contact portion 602B is formed at the central portion of the contact base 603B. The electrical contact portions 602A and 602B are portions that come into contact with the electrode 405.

The contact portion 611A supported by the first base portion 604A extends in a direction toward the second base portion 604B. The contact portion 611B supported by the second base portion 604B extends in a direction toward the first base portion 604A. When the electrical contact part 600 is pressed against the heater 400, the arm portion 601A and the arm portion 601B are elastically deformed. The contact base 603A is pressed against the electrode 405 by the elastic force of the arm 601A generated when the arm portion 601A is elastically deformed. Accordingly, the electrical contact portion 602A is pressed against the electrode 405 with a predetermined load, and electrical contact is made between the electrical contact portion 602A and the electrode 405. Further, the contact base 603B of the contact portion 611B is pressed against the electrode 405 by the elastic force of the arm portion 601B generated when the arm portion 601B is elastically deformed. Accordingly, the electrical contact portion 602B is pressed against the electrode 405 with a predetermined load, and electrical contact is made between the electrical contact portion 602B and the electrode 405. Thus, the contact portions 611A and 611B come into contact with the electrode 405 to be electrically connected to the electrode 405 in a state where an urging force is applied to the electrode 405 by the contact portions 611A and 611B.

The electrical contact portions 602A and 602B have R-shapes formed by drawing the contact bases 603A and 603B, respectively. The electrical contact part 600 is designed to come into point contact with the electrode 405 at the apex of the R-shape. The electrical contact portions 602A and 602B are pressed against the electrode 405 with a predetermined load so that the point contact portion is crushed a bit, thereby having good contact resistance. Further, the electrical contact part 600 includes the base portion 610, a fixing portion 609, an elastic portion 608 that is connected to the base portion 610 and the fixing portion 609, and a caulking portion 605 provided on the fixing portion 609. The elastic portion 608 is connected to the contact portions 611A and 611B via the base portion 610. The elastic portion 608 is provided between the contact portion 611A and the fixing portion 609. An electric wire 606 is caulked at a caulking portion 605 so that the electrical contact part 600 is electrically connected to a power source via the electric wire 606. The fixing portion 609 includes a flat plate portion 612 and a positioning portion 607 provided on the flat plate portion 612. As will be described later, the electrical contact part 600 in which a positioning boss 105B provided on the holding member 105 is inserted into the positioning portion 607 is fixed to the holding member 105 by the fixing portion 609.

Figure 15B:
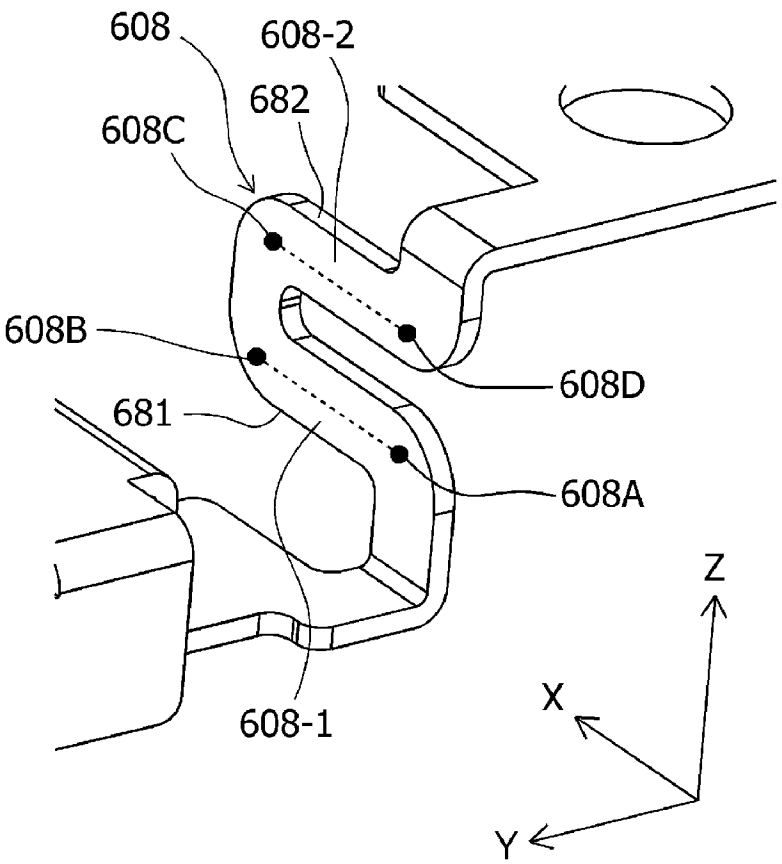
FIGS. 15A and 15B are a perspective view and an enlarged view of the electrical contact part according to the third embodiment.
Figure 15A:
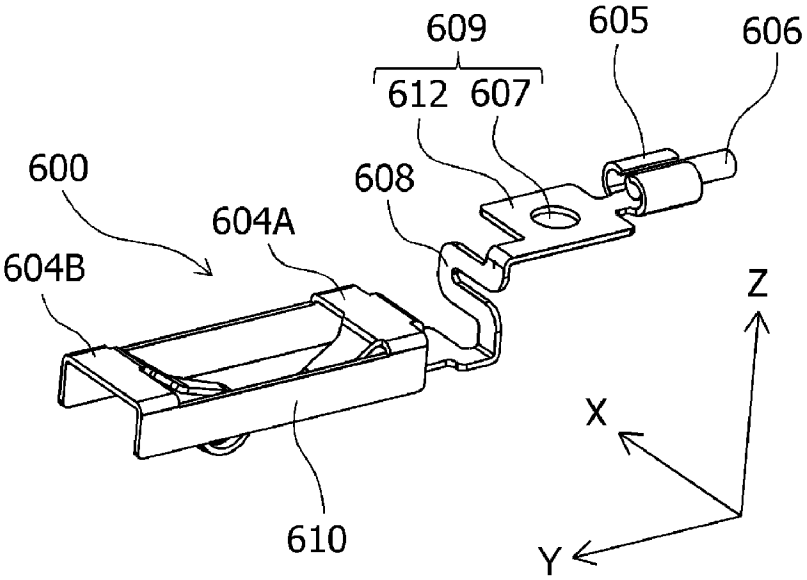

Next, the elastic portion 608 of the electrical contact part 600 will be described with reference to FIG. 15. FIG. 15A is a perspective view of the electrical contact part 600, and FIG. 15B is an enlarged view of the elastic portion 608. The X axis of the coordinate system illustrated in FIG. 15 is an axis parallel to the conveyance direction of the recording material P, the Y axis is an axis parallel to the longitudinal direction of the heater 400, and the Z axis is an axis perpendicular to the upper face of the electrode 405. The upper face of the electrode 405 is a face parallel to the conveyance direction of the recording material P, and is also a contact face with the electrical contact portions 602A and 602B in the electrode 405. The elastic portion 608 is a leaf spring and has a U-shaped bent portion. One end of the U-shaped bent portion is connected to the base portion 610, and the other end of the U-shaped bent portion is connected to the fixing portion 609. The U-shaped bent portion is displaceable in an X direction (e.g., the conveyance direction of the recording material P), a Y direction (e.g., a direction orthogonal to the conveyance direction of the recording material P and parallel to the upper face of the electrode 405), and a Z direction (e.g., the vertical direction of the upper face of the electrode 405). The U-shaped bent portion includes displacement portions 608-1 and 608-2. The displacement portions 608-1 and 608-2 have a sheet shape and extend on a plane substantially parallel to the XZ plane. The face having the largest area of the faces of the displacement portion 608-1 is substantially parallel to the XZ plane. A line connecting points 608A and 608B in the displacement portion 608-1 and a line connecting points 608C and 608D in the displacement portion 608-2 extend in the X direction. As described above, the U-shaped bent portion of the elastic portion 608 includes the displacement portions 608-1 and 608-2 extending in the X direction. The displacement portions 608-1 and 608-2 are displaceable in accordance with a change in the relative position between the fixing portion 609 and the electrode 405.

When the heater 400 and the fixing portion 609 move in such a direction that the relative positions of the fixing portion 609 and the electrode 405 are brought away from each other in the Y direction, the displacement portions 608-1 and 608-2 are displaced in the Y direction and away from the base portion 610. When the heater 400 and the fixing portion 609 move in such a direction that the relative positions of the fixing portion 609 and the electrode 405 are brought close to each other in the Y direction, the displacement portions 608-1 and 608-2 are displaced in the Y direction and toward the base portion 610.

When the heater 400 and the fixing portion 609 move in such a direction that the relative positions of the fixing portion 609 and the electrode 405 are brought away from each other in the Z direction, the displacement portions 608-1 and 608-2 are displaced in the Z direction and away from the heater 400. When the heater 400 and the fixing portion 609 move in such a direction that the relative positions of the fixing portion 609 and the electrode 405 are brought close to each other in the Z direction, the displacement portions 608-1 and 608-2 are displaced in the Z direction and toward the heater 400.

Both ends of the displacement portion 608-1 are directed in the X direction, one end of the displacement portion 608-1 is connected to the base portion 610, and the other end of the displacement portion 608-1 is connected to the displacement portion 608-2. The displacement portion 608-1 is displaceable in the Y direction and the Z direction, and a direction in which the displacement portion 608-1 is maximumly displaced is the Y direction. In other words, the displacement portion 608-1 is more easily displaced in the Y direction than in the Z direction. Both ends of the displacement portion 608-2 are directed in the X direction, one end of the displacement portion 608-2 is connected to the displacement portion 608-1, and the other end of the displacement portion 608-2 is connected to the fixing portion 609. The displacement portion 608-2 is displaceable in the Y direction and the Z direction, and a direction in which the displacement portion 608-2 is maximally displaced is the Y direction. In other words, the displacement portion 608-2 is more easily displaced in the Y direction than in the Z direction.

Figure 16:
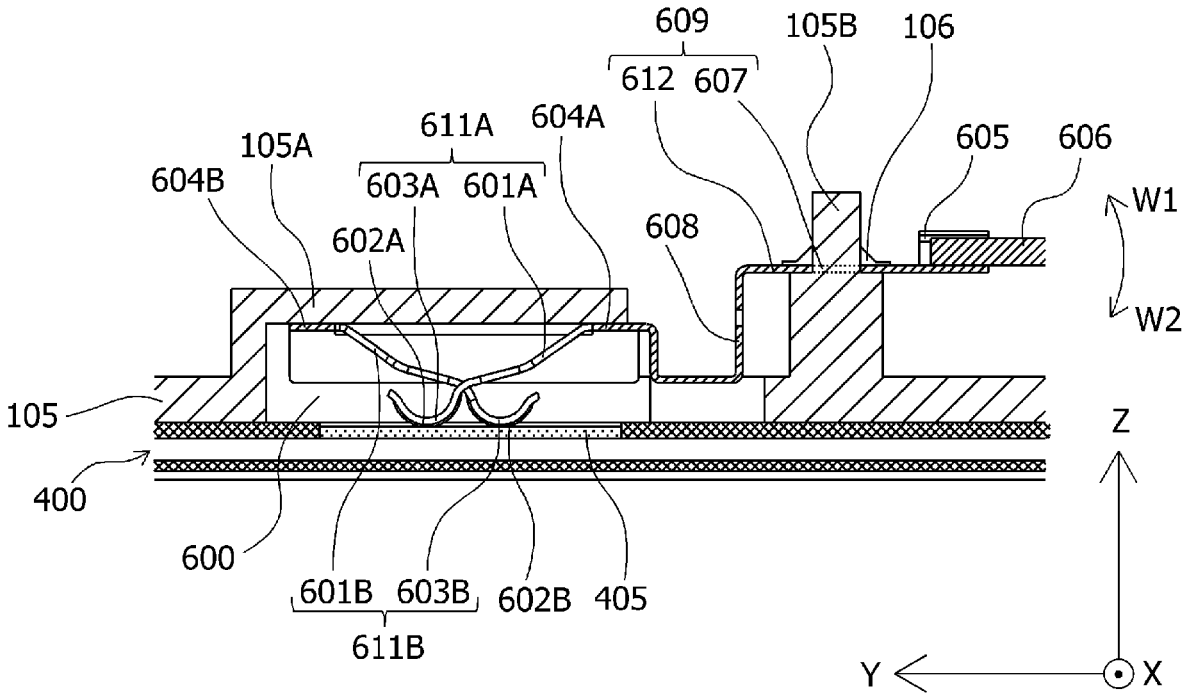
FIG. 16 is a partial cross-sectional view of the electrical contact part according to the third embodiment.

FIG. 16 is a partial cross-sectional view of the electrical contact part 600 along the longitudinal direction of the heater 400. FIG. 16 illustrates a holding configuration of the electrical contact part 600 electrically connected to one of the five electrodes 405. The X axis, Y axis, and Z axis in FIG. 16 are the same as the X axis, Y axis, and Z axis in FIG. 15. The contact portion 611A, the elastic portion 608, and the fixing portion 609 are arranged side by side in a direction orthogonal to the conveyance direction of the recording material P (the short direction of the heater 400) and parallel to the upper face of the electrode 405. The electrical contact part 600 is held by the holding member 105 by fitting the positioning portion 607 provided on the flat plate portion 612 to the positioning boss 105B of the holding member 105. In order to prevent the positioning portion 607 from slipping out of the positioning boss 105B, a push nut 106 is attached to the positioning boss 105B. Fixing the position of the positioning portion 607 suppresses a force in the Y direction applied to the electrical contact part 600 via the electric wire 606 during assembly, from affecting variations in the positions of the electrical contact portions 602A and 602B.

The first base portion 604A and the second base portion 604B are in contact with a contact holding portion 105A of the holding member 105. When the first base portion 604A and the second base portion 604B are not in contact with the contact holding portion 105A, the first base portion 604A and the second base portion 604B move away from the heater 400 by the pressing force applied to the electrodes 405 generated by the arm portions 601A and 601B. Bringing the first base portion 604A and the second base portion 604B into contact with the contact holding portion 105A suppresses the first base portion 604A and the second base portion 604B from moving in a direction away from the heater 400. It is to be noted that the heater 400 and the holding member 105 are in close contact with each other by pressing means (not illustrated).

Elastic Portion

Displacement of the elastic portion 608 when electric power is supplied to the heater 400 will be described with reference to FIG. 16. When the heater 400 generates heat, the heater 400 expands in the Y direction, and the position of the electrode 405 is instantaneously changed in the Y direction accordingly. On the other hand, at the beginning of heat transfer to the holding member 105, the holding member 105 does not expand immediately, so that the position of the positioning boss 105B is hardly changed. Therefore, due to the thermal expansion of the heater 400, the electrode 405 is displaced relative to the positioning boss 105B in the Y direction. Further, the electrical contact part 600 is held by the holding member 105 by fitting the positioning portion 607 to the positioning boss 105B, while the elastic portion 608 is elastically deformable. Even when the positional relationship between the positioning boss 105B and the electrode 405 changes relatively, the elastic portion 608 is elastically deformed in the Y direction, so that the positions of the electrical contact portions 602A and 602B follow the displacement of the electrode 405. Therefore, it is possible to suppress relative changes in the positional relationship between the electrical contact portions 602A and 602B and the electrode 405. In other words, the electrical contact portions 602A and 602B and the electrode 405 simultaneously move in the Y direction, so that mutual sliding can be suppressed. This operation is the same when the heater 400 contracts or when the control temperature of the heater 400 is changed.

Next, displacement of the elastic portion 608 relative to a posture change of the electric wire 606 will be described. When the electric wire 606 is routed to the power source, the electrical contact part 600 may be placed on the heater 400 in a state where the electric wire 606 is tilted in the direction of arrow W1 or W2 in FIG. 16 about a fulcrum provided in the vicinity of the positioning portion 607. In addition, the posture of the electric wire 606 may change during the operation of the image forming apparatus 1. For example, when the electric wire 606 is tilted in the direction of arrow W1, the fixing portion 609 is tilted in the direction of arrow W1 accordingly. When the fixing portion 609 is tilted in the direction of arrow W1, the amount of bending of the arm portions 601A and 601B may change. When the amount of bending of the arm portions 601A and 601B changes, the electrical contact portions 602A and 602B are displaced in the Y direction. Therefore, when the amount of bending of the arm portion 601 changes, the positional relationship between the electrode 405 and the electrical contact portions 602A and 602B changes relatively, so that wear between the electrode 405 and the electrical contact portion 602 occurs. In the present embodiment, the elastic portion 608 is displaceable not only in the Y direction but also in the Z direction, and when the elastic portion 608 contracts in the Z direction, the elastic portion 608 can absorb the tilt of the fixing portion 609 in the direction of arrow W1. The elastic portion 608 absorbing the posture change of the electric wire 606 in the direction of arrow W1 results in no change in the amount of bending of the arm portions 601A and 601B, thereby making it possible to suppress sliding between the electrode 405 and the electrical contact portions 602A and 602B. According to the present embodiment, it is possible to suppress sliding between the electrode 405 of the heater 400 and the contact portions 611A and 611B of the electrical contact part 600.

As described above, the relative position between the fixing portion 609 and the electrode 405 changes due to a thermal expansion of the heater 400 or a posture change of the electric wire 606. Here, movement of the elastic portion 608 in accordance with a change in the relative position between the fixing portion 609 and the electrode 405 will be described. The elastic portion 608 includes a first plate portion 681 including the displacement portion 608-1 extending in the X direction and a second plate portion 682 including the displacement portion 608-2 extending in the X direction. The displacement portion 608-1 is an example of a first portion. The displacement portion 608-2 is an example of a second portion. A first end of the first plate portion 681 is connected to the contact portions 611A and 611B via the base portion 610. A first end of the second plate portion 682 is connected to the fixing portion 609. A second end of the first plate portion 681 and a second end of the second plate portion 682 are connected to each other. The displacement portions 608-1 and 608-2 are arranged in parallel along the Z direction when viewed in the X direction. Further, the displacement portions 608-1 and 608-2 are arranged in parallel along the Z direction when viewed in the Y direction. The displacement portion 608-1 moves toward at least one of the Y direction and the Z direction in accordance with a change in the relative position between the fixing portion 609 and the electrode 405. The displacement portion 608-2 moves toward at least one of the Y direction and the Z direction in accordance with a change in the relative position between the fixing portion 609 and the electrode 405.

It is to be noted that the elastic portion 608 which is elastically deformable in the Y direction and the Z direction has a shape extending on a plane substantially parallel to the XZ plane as illustrated in the present embodiment, so that the size of the electrical contact part 600 in the longitudinal direction of the heater 400 can be reduced. If the length of the electrical contact part 600 in the longitudinal direction of the heater 400 is long, the electrical contact parts 600 cannot be densely arranged in a region in the longitudinal direction of the heater 400, and thus, the number of divided heat generating elements of the heater 400 is limited. Reducing the size of the electrical contact part 600 in the longitudinal direction of the heater 400 makes it possible to increase the number of divided heat generating elements of the heater 400.

As described above, the elastic portion 608 is elastically deformed in the Y direction, so that sliding between the electrode 405 and the electrical contact portions 602A and 602B during the thermal expansion and contraction of the heater 400 can be suppressed. In addition, even when the posture of the electric wire 606 changes, the elastic portion 608 is elastically deformed in the Z direction, thereby making it possible to suppress sliding between the electrode 405 and the electrical contact portions 602A and 602B. That is, according to the present embodiment, it is possible to suppress wear due to sliding between the electrode 405 of the heater 400 and the electrical contact portions 602A and 602B of the electrical contact part 600, and it is, therefore, possible to provide the image forming apparatus 1, the fixing apparatus 100, and the electrical contact part 600 that are highly durable and reliable.

Fourth Embodiment

Next, a fourth embodiment of the present invention will be described. The same portions/parts as those in the second embodiment are denoted by the same reference numerals as the second embodiment, and description thereof will be not repeated.

Figure 17:
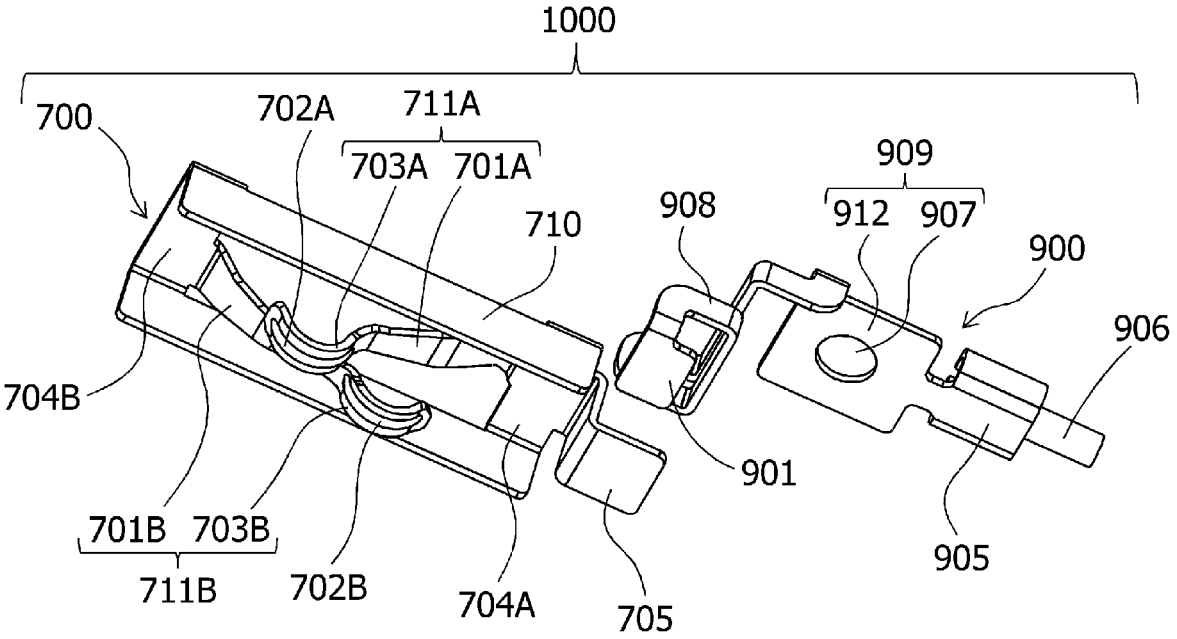
FIG. 17 is a perspective view of an electrical contact part according to a fourth embodiment.

FIG. 17 is a perspective view of an electrical contact part (power supply connector) 1000 according to the present embodiment. The electrical contact part 1000 is divided into an electrical contact part body 700 and an elastic member 900. FIG. 17 illustrates the electrical contact part 1000 in a state where the electrical contact part body 700 and the elastic member 900 are not connected to each other. As with the electrical contact part 600 of the third embodiment, the electrical contact part 1000 is placed on the heater 400 with being held by the contact holding portion 105A of the holding member 105.

The electrical contact part body 700 is a pressed part processed by bending a metal plate, and includes a base portion (supporting portion) 710 and contact portions (terminal portions) 711A and 711B. The base portion 710 includes a first base portion 704A and a second base portion 704B that are not directly connected to each other. The first base portion 704A supports the contact portion 711A, and the second base portion 704B supports the contact portion 711B. The first base portion 704A and the second base portion 704B have a plate shape. The contact portion 711A includes an arm portion 701A and a contact base 703A. The arm portion 701A extends from the first base portion 704A, and the contact base 703A is provided at the tip of the arm portion 701A. An electrical contact portion 702A is formed at the central portion of the contact base 703A. The contact portion 711B includes an arm portion 701B and a contact base 703B. The arm portion 701B extends from the second base portion 704B, and the contact base 703B is provided at the tip of the arm portion 701B. An electrical contact portion 702B is formed at the central portion of the contact base 703B. The electrical contact portions 702A and 702B are portions that come into contact with the electrode 405.

The contact portion 711A supported by the first base portion 704A extends in a direction toward the second base portion 704B. The contact portion 711B supported by the second base portion 704B extends in a direction toward the first base portion 704A. When the electrical contact part body 700 is pressed against the heater 400, the arm portion 701A and the arm portion 701B are elastically deformed. The contact base 703A is pressed against the electrode 405 by the elastic force of the arm portion 701A generated when the arm portion 701A is elastically deformed. Accordingly, the electrical contact portion 702A is pressed against the electrode 405 with a predetermined load, and electrical contact is made between the electrical contact portion 702A and the electrode 405. Further, the contact base 703B of the contact portion 711B is pressed against the electrode 405 by the elastic force of the arm portion 701B generated when the arm portion 701B is elastically deformed. Accordingly, the electrical contact portion 702B is pressed against the electrode 405 with a predetermined load, and electrical contact is made between the electrical contact portion 702B and the electrode 405. Thus, the contact portions 711A and 711B come into contact with the electrode 405 to be electrically connected to the electrode 405 in a state where an urging force is applied to the electrode 405 by the contact portions 711A and 711B. The electrical contact portions 702A and 702B have R-shapes formed by drawing the contact bases 703A and 703B, respectively. The electrical contact part 1000 is designed to come into point contact with the electrode 405 at the apex of the R-shape. The electrical contact portions 702A and 702B are pressed against the electrode 405 with a predetermined load so that the point contact portion is crushed a bit, thereby having good contact resistance.

The electrical contact part body 700 also includes a joint portion 705 connected to the base portion 710. The joint portion 705 extends from the first base portion 704A. The joint portion 705 also extends in a direction opposite to the direction in which the arm portion 701A extends. The elastic member 900 includes a fixing portion 909, an elastic portion 908 connected to the fixing portion 909, and a caulking portion 905 provided on the fixing portion 909. The elastic portion 908 is elastically deformable. A joint portion 901 is provided at the tip of the elastic portion 908. The electrical contact part body 700 and the elastic member 900 are connected to each other by welding the joint portion 705 of the electrical contact part body 700 and the joint portion 901 of the elastic member 900. Alternatively, the electrical contact part body 700 and the elastic member 900 may be connected to each other by fastening the joint portion 705 of the electrical contact part body 700 and the joint portion 901 of the elastic member 900. In a state where the electrical contact part body 700 and the elastic member 900 are connected to each other, the elastic portion 908 is provided between the contact portion 711A and the fixing portion 909. In a state where the electrical contact part body 700 and the elastic member 900 are connected to each other, the elastic portion 908 is connected to the contact portions 711A and 711B via the base portion 710. An electric wire 906 is caulked at the caulking portion 905 so that the electrical contact part 1000 is electrically connected to a power source via the electric wire 906. The fixing portion 909 includes a flat plate portion 912 and a positioning portion 907 provided on the flat plate portion 912. The electrical contact part 1000 in which the positioning boss 105B provided on the holding member 105 is inserted into the positioning portion 907 is fixed to the holding member 105 by the fixing portion 909. The electrical contact part 1000 is held by the holding member 105 by fitting the positioning portion 907 provided on the flat plate portion 912 to the positioning boss 105B of the holding member 105. As in the third embodiment, in order to prevent the positioning portion 907 from slipping out of the positioning boss 105B, the push nut 106 may be attached to the positioning boss 105B.

Figure 18B:
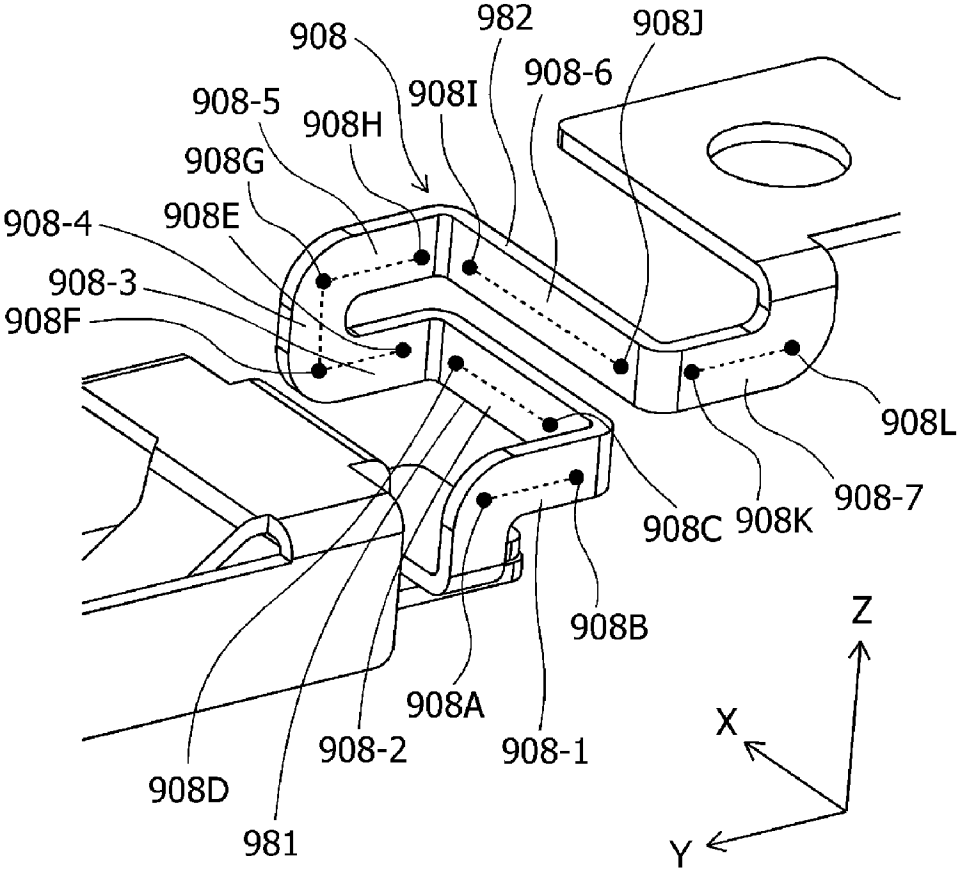
FIGS. 18A and 18B are a perspective view of the electrical contact part and an enlarged view of an elastic portion according to the fourth embodiment.
Figure 18A:
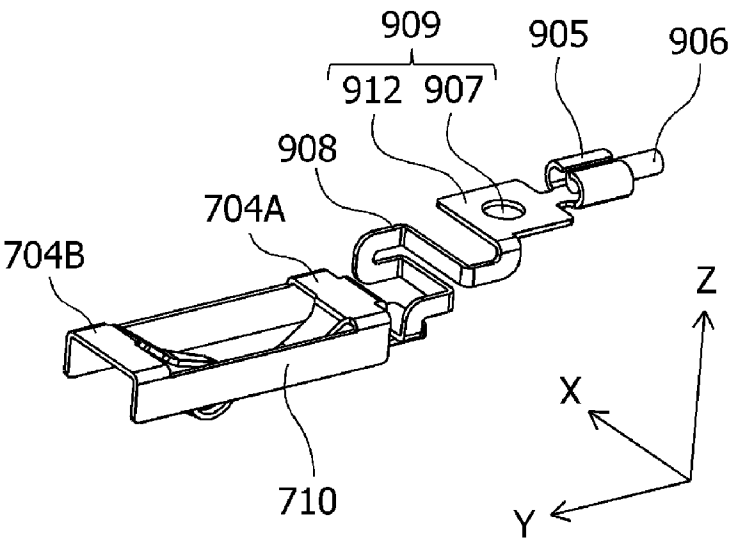

Next, the elastic portion 908 of the electrical contact part 1000 will be described with reference to FIGS. 18A and 18B. FIG. 18A is a perspective view of the electrical contact part 1000 when the electrical contact part body 700 and the elastic member 900 are connected to each other. FIG. 18B is an enlarged view of the elastic portion 908. The X axis of the coordinate system illustrated in FIGS. 18A and 18B is an axis parallel to the conveyance direction of the recording material P, the Y axis is an axis parallel to the longitudinal direction of the heater 400, and the Z axis is an axis perpendicular to the upper face of the electrode 405. The upper face of the electrode 405 is a face parallel to the conveyance direction of the recording material P, and is also a contact face with the electrical contact portions 702A and 702B in the electrode 405. When the electrical contact part 1000 is placed on the heater 400, the contact portion 711A, the elastic portion 908, and the fixing portion 909 are arranged side by side in a direction orthogonal to the conveyance direction of the recording material P (the short direction of the heater 400) and parallel to the upper face of the electrode 405. The elastic portion 908 is a leaf spring and includes a plurality of L-shaped bent portions and a U-shaped bent portion. One end of an L-shaped first bent portion is connected to the base portion 710, and the other end of the L-shaped first bent portion is connected to the U-shaped bent portion. One end of the U-shaped bent portion is connected to the L-shaped first bent portion, and the other end of the U-shaped bent portion is connected to the L-shaped second bent portion. One end of the L-shaped second bent portion is connected to the U-shaped bent portion, and the other end of the L-shaped second bent portion is connected to the fixing portion 909. The L-shaped first bent portion includes displacement portions 908-1 and 908-2. The U-shaped bent portion includes displacement portions 908-3, 908-4, and 908-5. The L-shaped second bent portion includes displacement portions 908-6 and 908-7.

The displacement portions 908-1 to 908-7 are displaceable in accordance with a change in the relative position between the fixing portion 909 and the electrode 405.

The displacement portions 908-1, 908-3, 908-4, 908-5, and 908-7 have a sheet shape and extend on a plane substantially parallel to the YZ plane. For example, the face having the largest area of the faces of the displacement portion 908-1 is substantially parallel to the YZ plane. The displacement portions 908-2 and 908-6 have a sheet shape and extend on a plane substantially parallel to the XZ plane. For example, the face having the largest area of the faces of the displacement portion 908-2 is substantially parallel to the XZ plane. A line connecting points 908A and 908B in the displacement portion 908-1 and a line connecting points 908E and 908F in the displacement portion 908-3 extend in the Y direction. Further, a line connecting points 908G and 908H in the displacement portion 908-5 and a line connecting points 908K and 908L in the displacement portion 908-7 extend in the Y direction. A line connecting points 908C and 908D in the displacement portion 908-2 and a line connecting points 9081 and 908J in the displacement portion 908-6 extend in the X direction. A line connecting the points 908F and 908G in the displacement portion 908-4 extends in the Z direction. The L-shaped first bent portion of the elastic portion 908 includes the displacement portion 908-1 extending in the Y direction and the displacement portion 908-2 extending in the X direction. The U-shaped bent portion of the elastic portion 908 includes the displacement portions 908-3 and 908-5 extending in the Y direction and the displacement portion 908-4 extending in the X direction. The L-shaped second bent portion of the elastic portion 908 includes the displacement portion 908-6 extending in the X direction and the displacement portion 908-7 extending in the Y direction.

Both ends of the displacement portion 908-1 are directed in the Y direction, one end of the displacement portion 908-1 is connected to the base portion 710, and the other end of the displacement portion 908-1 is connected to the displacement portion 908-2. The displacement portion 908-1 is displaceable in the X direction and the Z direction, and a direction in which the displacement portion 908-1 is maximumly displaced is the X direction. In other words, the displacement portion 908-1 is more easily displaced in the X direction than in the Z direction. Both ends of the displacement portion 908-2 are directed in the X direction, one end of the displacement portion 908-2 is connected to the displacement portion 908-1, and the other end of the displacement portion 908-2 is connected to the displacement portion 908-3. The displacement portion 908-2 is displaceable in the Y direction and the Z direction, and a direction in which the displacement portion 908-2 is maximumly displaced is the Y direction. In other words, the displacement portion 908-2 is more easily displaced in the Y direction than in the Z direction. As with the displacement portion 908-1, the displacement portions 908-3, 908-5, and 908-7 are displaceable in the X direction and the Z direction, and a direction in which each of the displacement portions 908-3, 908-5, and 908-7 is maximumly displaced is the X direction. In other words, the displacement portions 908-3, 908-5, and 908-7 are more easily displaced in the X direction than in the Z direction. Both ends of the displacement portion 908-4 are directed in the Z direction, one end of the displacement portion 908-4 is connected to the displacement portion 908-3, and the other end of the displacement portion 908-4 is connected to the displacement portion 908-5. The displacement portion 908-4 is displaceable in the X direction and the Y direction, and a direction in which the displacement portion 908-4 is maximumly displaced is the X direction. In other words, the displacement portion 908-4 is more easily displaced in the X direction than in the Y direction. As with the displacement portion 908-2, the displacement portion 908-6 is displaceable in the Y direction and the Z direction, and a direction in which the displacement portion 908-5 is maximumly displaced is the Y direction. In other words, the displacement portion 908-5 is more easily displaced in the Y direction than in the Z direction.

The displacement portion 908-7 may extend on a plane substantially parallel to the XZ plane, and the displacement portion 908-7 may extend in the Z direction. For example, both ends of the displacement portion 908-7 may be directed in the Z direction, one end of the displacement portion 908-7 may be connected to the displacement portion 908-6, and the other end of the displacement portion 908-7 may be connected to the fixing portion 909. In this case, the displacement portion 908-7 is displaceable in the X direction and the Y direction, and a direction in which the displacement portion 908-7 is maximumly displaced is the Y direction. In other words, the displacement portion 908-7 is more easily displaced in the Y direction than in the X direction. The displacement portion 908-7 may extend on a plane substantially parallel to the XY plane, and the displacement portion 908-7 may extend in the Y direction. For example, both ends of the displacement portion 908-7 may be directed in the Y direction, one end of the displacement portion 908-7 may be connected to the displacement portion 908-6, and the other end of the displacement portion 908-7 may be the fixing portion 909. In this case, the displacement portion 908-7 is displaceable in the X direction and the Z direction, and a direction in which the displacement portion 908-7 is maximumly displaced is the Z direction. In other words, the displacement portion 908-7 is more easily displaced in the Z direction than in the X direction. The displacement portion 908-2 may extend on a plane substantially parallel to the XY plane, and the displacement portion 908-2 may extend in the X direction. For example, both ends of the displacement portion 908-2 may be directed in the X direction, one end of the displacement portion 908-2 may be connected to the displacement portion 908-1, and the other end of the displacement portion 908-2 may be connected to the displacement portion 908-3. In this case, the displacement portion 908-2 is displaceable in the Y direction and the Z direction, and a direction in which the displacement portion 908-3 is maximumly displaced is the Z direction. In other words, the displacement portion 908-3 is more easily displaced in the Z direction than in the Y direction.

As described above, the relative position between the fixing portion 909 and the electrode 405 changes due to a thermal expansion of the heater 400 or a posture change of the electric wire 906. Here, movement of the elastic portion 908 in accordance with a change in the relative position between the fixing portion 909 and the electrode 405 will be described. The elastic portion 908 includes a first plate portion 981 including the displacement portion 908-2 extending in the X direction and a second plate portion 982 including the displacement portion 908-6 extending in the X direction. The displacement portion 908-2 is an example of a first portion. The displacement portion 908-6 is an example of a second portion. A first end of the first plate portion 981 is connected to the contact portions 911A and 911B via the base portion 910. A first end of the second plate portion 982 is connected to the fixing portion 909. A second end of the first plate portion 981 and a second end of the second plate portion 982 are connected to each other. The displacement portions 908-2 and 908-6 are arranged in parallel along the Z direction when viewed in the X direction. The displacement portions 908-2 and 908-6 are arranged in parallel along the Z direction when viewed from the Y direction. The first plate portion 981 includes the displacement portions 908-1 and 908-3 extending in the Y direction. The displacement portions 908-1 and 908-3 are examples of a third portion. The second plate portion 982 includes the displacement portions 908-5 and 908-7 extending in the Y direction. The displacement portions 908-5 and 908-7 are examples of a fourth portion. The displacement portion 908-2 moves toward at least one of the Y direction and the Z direction in accordance with a change in the relative position between the fixing portion 909 and the electrode 405. The displacement portion 908-6 moves toward at least one of the Y direction and the Z direction in accordance with a change in the relative position between the fixing portion 909 and the electrode 405. At least one of the displacement portions 908-1 and 908-3 moves toward at least one of the X direction and the Z direction in accordance with a change in the relative position between the fixing portion 909 and the electrode 405. At least one of the displacement portions 908-5 and 908-7 moves toward at least one of the X direction and the Z direction in accordance with a change in the relative position between the fixing portion 909 and the electrode 405. The displacement portion 908-2 of the first plate portion 981 may be connected to the contact portions 711A and 711B via the base portion 710 without providing the displacement portion 908-1 in the elastic portion 908. The displacement portion 908-6 of the second plate portion 982 may be connected to the fixing portion 909 without providing the displacement portion 908-7 in the elastic portion 908. Further, the end of the displacement portion 908-2 and the end of the displacement portion 908-6 may be connected to each other without providing the displacement portions 908-3, 908-4 and 908-5 in the elastic portion 908.

As compared to the elastic portion 608 of the third embodiment, the elastic portion 908 includes more portions that are displaceable in the Z direction, and therefore, the elastic portion 908 can absorb the displacement of the fixing portion 909 in the Z direction more. Further, since the elastic portion 908 includes the L-shaped first bent portion and the L-shaped second bent portion as well as the U-shaped bent portion, the length of the elastic portion 908 is longer than the length of the elastic portion 608 of the third embodiment. As a result, as compared to the elastic portion 608 of the third embodiment, the elastic portion 908 has a larger amount of displacement in the Y direction in the same space. Therefore, the elastic portion 908 can absorb the thermal expansion of the heater 400 in the Y direction more greatly. Accordingly, the elastic portion 908 can follow the thermal expansion of the heater 400 in the Y direction more.

If the electrical contact part body 700 and the elastic member 900 are integrated, it is difficult to process a complicated combination of arm portions such as the elastic portion 908. By contrast, the present embodiment makes it easy to process the elastic portion 908 by separately processing the electrical contact part body 700 and the elastic member 900. As described above, separating the electrical contact part 1000 into the electrical contact part body 700 and the elastic member 900 and including an increased number of displacement portions in the elastic portion 908 make it possible to elastically deform the elastic portion 908 in the Y direction and the Z direction with a weaker force. Accordingly, the followability of the electrical contact part 1000 to the electrode 405 with respect to the thermal expansion of the heater 400 can be improved. In addition, it is possible to improve the absorptive of the posture change of the electric wire 906, and it is, therefore, possible to provide the heater power supply configuration and the fixing apparatus with higher durability and reliability.

In the third and fourth embodiments, the electrode and the contact portion are in contact with each other by using the elasticity of the contact portion. In addition, the present invention may be applied to a configuration in which the contact portion is joined to the electrode. For example, in the third embodiment, the electrical contact portions 602A and 602B may be joined to the electrode 405 by soldering. For example, in the fourth embodiment, the electrical contact portions 702A and 702B may be joined to the electrode 405 by soldering. In such ways, the elastic portion described in the third and fourth embodiments may be provided in an electrical contact part having the configuration in which the contact portions 611A and 611B are joined to the electrode 405, and an electrical contact part having the configuration in which the contact portions 711A and 711B are joined to the electrode 405.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-222243, filed on Nov. 28, 2018, and Japanese Patent Application No. 2018-232838, filed on Dec. 12, 2018 which are hereby incorporated by reference herein in their entirety.

What is claimed is:

1. An image heating apparatus for heating an image formed on a recording material, comprising:

a heater including a plurality of heat generating elements, and a plurality of electrodes electrically connected to the plurality of heat generating elements, respectively and arranged in an orthogonal direction of a conveyance direction of a recording material; and a plurality of connectors for supplying electric power to each of the plurality of electrodes, the plurality of connectors consisting of metal, wherein each of the plurality of connectors includes a plurality of contact portions that come into contact with one of the plurality of electrodes, a first supporting portion that supports a first contact portion that is one of the plurality of contact portions, and a second supporting portion that supports a second contact portion that is one of the plurality of contact portions, the first supporting portion and the second supporting portion are arranged to be spaced apart from each other in the orthogonal direction, the first contact portion extends from the first supporting portion toward the second supporting portion, the second contact portion extends from the second supporting portion toward the first supporting portion, and the first contact portion and the second contact portion are in contact with the one of the plurality of electrodes at different positions.

2. The image heating apparatus according to claim 1, wherein the first contact portion and the second contact portion are arranged side by side in the orthogonal direction.

3. The image heating apparatus according to claim 2, wherein the first contact portion includes a first electrical contact portion that forms electrical contact with the one of the plurality of electrodes, the second contact portion includes a second electrical contact portion that forms electrical contact with the one of the plurality of electrodes, and the first electrical contact portion and the second electrical contact portion are arranged side by side in the orthogonal direction.

4. The image heating apparatus according to claim 1, wherein the first contact portion and the second contact portion are arranged side by side in the conveyance direction.

5. The image heating apparatus according to claim 4, wherein the first supporting portion supports a third contact portion that is one of the plurality of contact portions, the second supporting portion supports a fourth contact portion that is one of the plurality of contact portions, the third contact portion extends from the first supporting portion toward the second supporting portion, the fourth contact portion extends from the second supporting portion toward the first supporting portion, the first contact portion, the second contact portion, the third contact portion, and the fourth contact portion are in contact with the one of the plurality of electrodes at different positions, and the first contact portion and the fourth contact portion are arranged side by side in the orthogonal direction, and the second contact portion and the third contact portion are arranged side by side in the orthogonal direction.

6. The image heating apparatus according to claim 4, wherein the first contact portion includes a first electrical contact portion that forms electrical contact with the one of the plurality of electrodes, and a first recessed portion that is provided between the first supporting portion and the first electrical contact portion and is recessed in the orthogonal direction and away from the second contact portion, the second contact portion includes a second electrical contact portion that forms electrical contact with the one of the plurality of electrodes, and a second recessed portion that is provided between the second supporting portion and the second electrical contact portion and is recessed in the orthogonal direction and away from the first contact portion, the first recessed portion and the second electrical contact portion are arranged side by side in the conveyance direction, and the second recessed portion and the first electrical contact portion are arranged side by side in the conveyance direction.

7. The image heating apparatus according to claim 4, wherein the first contact portion includes a first electrical contact portion that forms electrical contact with the one of the plurality of electrodes, and a first curved portion that is provided between the first supporting portion and the first electrical contact portion and curves in the orthogonal direction and away from the second contact portion, the second contact portion includes a second electrical contact portion that forms electrical contact with the one of the plurality of electrodes, and a second curved portion that is provided between the second supporting portion and the second electrical contact portion and curves in the orthogonal direction and away from the first contact portion, the first curved portion and the second electrical contact portion are arranged side by side in the conveyance direction, and the second curved portion and the first electrical contact portion are arranged side by side in the conveyance direction.

8. The image heating apparatus according to claim 1, wherein the first contact portion and the second contact portion are elastically deformable, the first contact portion is pressed against the one of the plurality of electrodes by an elastic force of the first contact portion generated when the first contact portion is elastically deformed, and the second contact portion is pressed against the one of the plurality of electrodes by an elastic force of the second contact portion generated when the second contact portion is elastically deformed.

9. The image heating apparatus according to claim 8, wherein the elastic force of the first contact portion and the elastic force of the second contact portion are different from each other.

10. The image heating apparatus according to claim 1, further comprising a tubular film, wherein the heater is provided in an inner space of the film.

11. The image heating apparatus according to claim 10, further comprising a roller for forming a nip portion with the heater through the film, wherein the image on the recording material is heated at the nip portion while the recording material is nipped and conveyed at the nip portion.

12. An image heating apparatus comprising:

a heater including an elongated substrate, a plurality of heat generating elements provided on the substrate, and a plurality of electrodes provided on the substrate and electrically connected to the plurality of heat generating elements, respectively;

a plurality of connectors that are each connected to one of the plurality of electrodes, the plurality of connectors consisting of metal; and a holding member that holds the heater, wherein the heater generates heat with electric power supplied via the plurality of connectors, and an image formed on a recording material is heated using the heat of the heater, and each of the connectors includes a contact portion that comes in contact with the electrode to be electrically connected to the electrode, a fixing portion for fixing the connector to the holding member, and an elastically deformable elastic portion that is provided between the contact portion and the fixing portion.

13. The image heating apparatus according to claim 12, wherein the contact portion, the elastic portion, and the fixing portion are arranged side by side in a second direction orthogonal to a first direction that is a conveyance direction of the recording material, and parallel to an upper face of the electrode, the elastic portion includes a first plate portion including a first portion extending in the first direction and a second plate portion including a second portion extending in the first direction, a first end of the first plate portion is connected to the contact portion, a first end of the second plate portion is connected to the fixing portion, a second end of the first plate portion and a second end of the second plate portion are connected to each other, the first portion and the second portion are arranged in parallel when viewed in the first direction, and the first portion moves toward at least one of the second direction and a third direction perpendicular to the upper face of the electrode, and the second portion moves toward at least one of the second direction and the third direction in accordance with a change in a relative position between the fixing portion and the electrode.

14. The image heating apparatus according to claim 13, wherein the first plate portion includes at least one third portion extending in the second direction, and the at least one third portion moves toward at least one of the first direction and the third direction in accordance with the change in the relative position between the fixing portion and the electrode.

15. The image heating apparatus according to claim 13, wherein the second plate portion includes at least one fourth portion extending in the second direction, and the at least one fourth portion moves toward at least one of the first direction and the third direction in accordance with the change in the relative position between the fixing portion and the electrode.

16. The image heating apparatus according to claim 12, wherein the contact portion is in contact with the electrode in a state where an urging force is applied to the electrode by the contact portion.

17. The image heating apparatus according to claim 12, wherein the contact portion is in contact with the electrode in a state where the contact portion is joined to the electrode.

18. The image heating apparatus according to claim 12, wherein the connector is configured by connecting at least two members by welding or fastening.

19. The image heating apparatus according to claim 12, further comprising a tubular film, wherein the heater is provided in an inner space of the film.

20. The image heating apparatus according to claim 19, further comprising a roller for forming a nip portion with the heater through the film, wherein the image on the recording material is heated at the nip portion while the recording material is nipped and conveyed at the nip portion.

* * * * *